US007878918B2

(12) United States Patent
Loh

(10) Patent No.: US 7,878,918 B2
(45) Date of Patent: Feb. 1, 2011

(54) PORTABLE SWING TRAINER

(76) Inventor: Cheng Wah Loh, 8818 Emperor Ave., San Gabriel, CA (US) 91775

( * ) Notice: Subject to any disclaimer, the term of this patent is extended or adjusted under 35 U.S.C. 154(b) by 0 days.

(21) Appl. No.: 12/715,717

(22) Filed: Mar. 2, 2010

(65) Prior Publication Data

US 2010/0160060 A1 Jun. 24, 2010

Related U.S. Application Data

(63) Continuation-in-part of application No. 12/319,202, filed on Jan. 2, 2009, now Pat. No. 7,704,154, and a continuation of application No. 11/895,662, filed on Aug. 27, 2007, now Pat. No. 7,704,153.

(60) Provisional application No. 61/284,597, filed on Dec. 22, 2009.

(51) Int. Cl.
*A63B 69/36* (2006.01)

(52) U.S. Cl. ..... 473/225; 473/148; 473/219; 473/221

(58) Field of Classification Search ..... 473/139, 473/140, 147, 148, 151, 198, 199, 209, 219, 473/221, 222, 225, 257, 278, 279
See application file for complete search history.

(56) References Cited

U.S. PATENT DOCUMENTS

| | | | | |
|---|---|---|---|---|
| 3,601,408 | A * | 8/1971 | Wright | 473/225 |
| 5,685,782 | A * | 11/1997 | Lipps et al. | 473/209 |
| 5,718,639 | A * | 2/1998 | Bouton | 473/151 |
| 6,821,211 | B2 * | 11/2004 | Otten et al. | 473/219 |
| 7,704,153 | B2 * | 4/2010 | Loh et al. | 473/221 |
| 7,704,154 | B2 * | 4/2010 | Loh et al. | 473/221 |

* cited by examiner

*Primary Examiner*—Nini Legesse
(74) *Attorney, Agent, or Firm*—Clement Cheng

(57) ABSTRACT

A portable swing trainer has a wedge body of a triangular shape, and a stick sensor having a vertical adjustment and a horizontal adjustment. The stick sensor has a deployed position and a collapsed position. The stick sensor is mounted behind the wedge body. A restoring mechanism can be for restoring the stick sensor from the collapsed position to the deployed position. The restoring mechanism is mounted behind the wedge body. The stick sensor is pivotally mounted to the restoring mechanism. A catch mechanism is for catching the stick sensor in collapsed position. The catch mechanism is mounted behind the wedge body. A pair of electronic beam sensors can be mounted in a pair of depressions formed on a face of the wedge body.

12 Claims, 18 Drawing Sheets

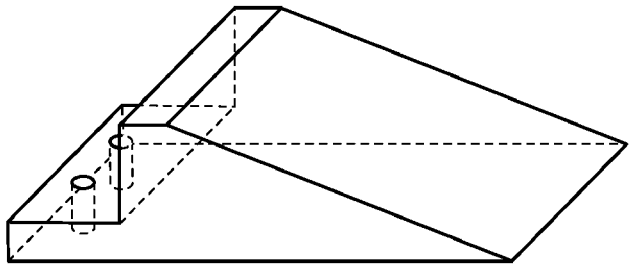
Fig. 8A
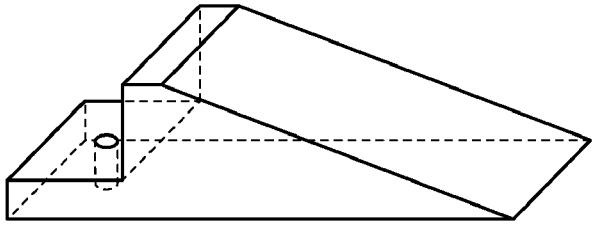
Fig. 8B
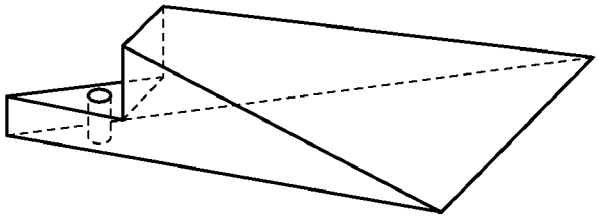
Fig. 8C
Fig. 8

Coil Spring
Elastic Stick
Brush Material
Elastic Stick
Coil Spring
Elastic Stick
Cylinder
Cone
Threaded Cylinder Fig. 10A
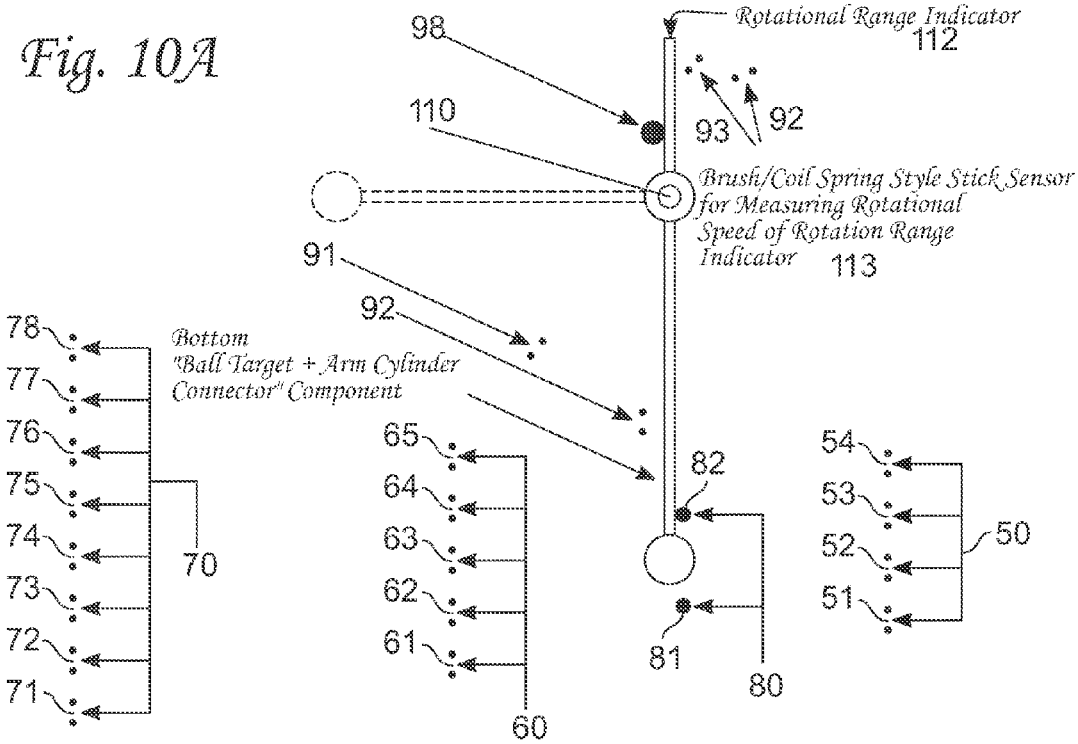
Fig. 10B
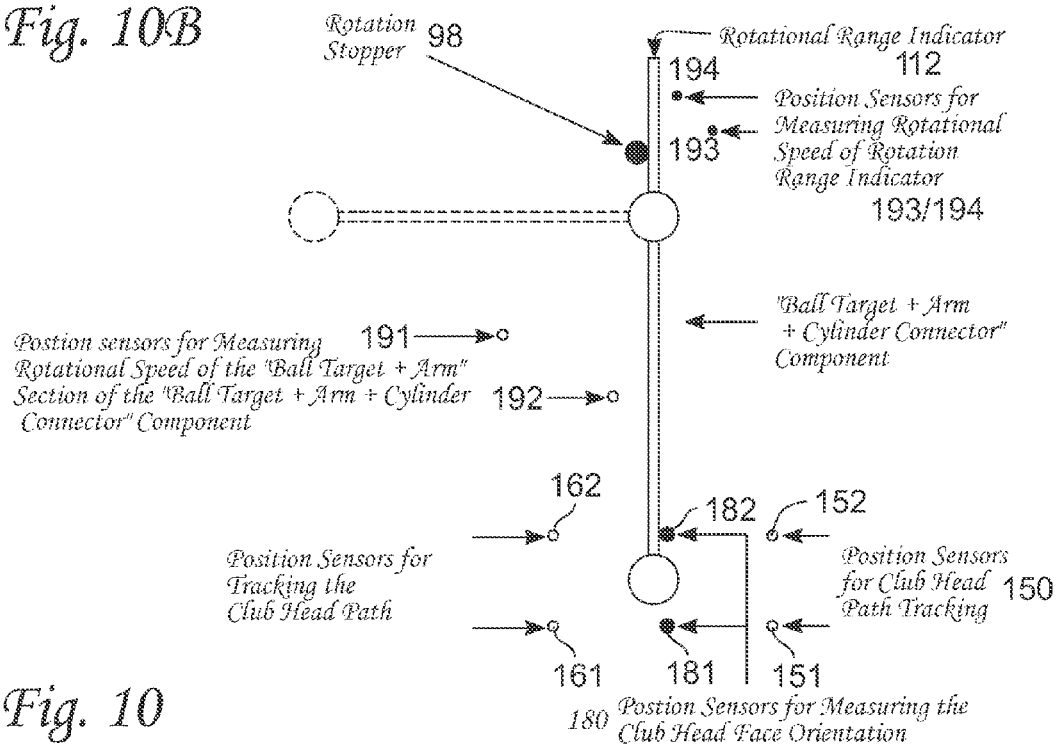
Fig. 10

PORTABLE SWING TRAINER

This application is a continuation in part of U.S. patent application Ser. No. 12/319,202 entitled Improved Golf Swing Trainer filed Jan. 2, 2009 now U.S. Pat. No. 7,704,154 by inventor Cheng Wah Loh and also a continuation of U.S. patent application Ser. No. 11/895,662 entitled Golf Swing Trainer filed Aug. 27, 2007 now U.S. Pat. No. 7,704,153 by inventor Cheng Wah Loh, both of the disclosure of which are incorporated herein by reference. This application also claims priority from provisional application No. 61/284,597 filed Dec. 22, 2009 by inventor Cheng Wah Loh.

BACKGROUND OF THE INVENTION

1. Field of the Invention

This invention relates generally to the field of apparatus for a golf training, practice, and coaching device.

2. Discussion of Related Art

A variety of golf assistance devices had been invented. For example, Golf 'Swing For Accuracy' Mat U.S. Pat. No. 6,554,716 patented Apr. 29, 2003 shows a device having a mat and a pair of connecting arms holding ball targets that assist the user in improving a golf swing. The disclosure of U.S. Pat. No. 6,554,716 is incorporated herein by reference.

Additionally, a variety of motion sensing contraptions have been devised for golf training purposes. Some golf swing sensing devices have tracked a golf ball for determining and analyzing swing characteristics. These golf swing sensing devices with golf ball tracking allow virtual display of a golf ball flight path for allowing indoor golf simulation and golf practice.

A variety of golf simulation games have been created for virtual golf indoor simulation. However, the mechanical input apparatus has not been as advanced as the improvements in graphics and golf ball flight calculation. Currently, given the input, golf simulation can calculate flight of a golf ball accounting for many factors such as spin, initial velocity, club head speed, golf ball type, and wind. Unfortunately, the mechanical input apparatus has been lacking. Some systems use a tracking device for tracking the initial path of a golf ball to determine initial velocity, and direction. These systems, while they provide an excellent processing of input information, do not fare well in accounting for the ball spin and club face impact angle. So while algorithms are well developed based on fundamental physics, development of a mechanical input apparatus has been lacking in comparison.

SUMMARY OF THE INVENTION

The invention is an apparatus for teaching and practicing a golf swing. The major parts of the apparatus include a microprocessor, a display, a ball holder, a ball holding cup component an orientation sensor, and three or more linear position sensors. Also, a display having LED feedback alone without a microprocessor may be cheaper and have a market advantage. The orientation sensor detects how straight the golf club travel is and consequently the golf club face orientation during impact, while the position sensors, working together, detect the path and position of the club head. The microprocessor takes the information given by the sensors and sends the information to the display. The goal of the user is to find the perfect curve through practice on the driving range as defined by the positions of the sensors and place the sensors on three points or more of the said curve. The apparatus may be used in conjunction with the device of U.S. Pat. No. 6,554,716, the disclosure of which is incorporated herein by reference. The ball holder preferably holds a ball so that the user can use the ball holder to avoid dislodging the ball while hitting the practice ball target below.

Two position sensors are placed on both sides of and preferably no more than a few inches away from the golf ball which is sitting on the vertically movable and adjustable elastic plastic or rubber ball holding cup at the proper position waiting to be hit. These two position sensors and the golf ball are sitting along a straight line connecting the target to the golf ball to form the so called target line. The two sensors are also properly positioned so that when the club head passes along and right above of the target line, it will also pass above the two position sensors before and after making contact with the ball. The two position sensors can be moved along the target line on both sides of the golf ball so that when the club head passes right above each position sensor, the distance between the club head and each position sensor will be within the sensing distance of each sensor and each position sensor will be triggered in sequence.

When a sensor is triggered it will light up an LED on the LED display of a special color corresponding to that sensor for a short instant to indicate that that club head is right above that sensor at that moment. Regarding the colors, it would be obvious to have green signify a good stroke, yellow a marginal stroke, and red a poor stroke. The positions of the two position sensors are closely associated with the curve or path traced by the club head and thus a major factor in determining the projectile of the golf ball in that particular swing. If the user hits a good shot with a particular position set up or arrangement of the position sensors around the golf ball at the driving range with both position sensors triggered and the corresponding LEDs lighting up, the user can record the position of each sensor for further analysis. Once the user has a swing with the same set up or arrangement of the sensors with respect to the golf ball, the user can practice the same stroke for muscle memory. The third position sensor mounted on a post is added to locate the club head in some special section of the swing such as at the beginning or ending of the swing to help define the curve of the golf swing with one more data point. If more data points are needed, more position sensors mounted on post stands will be used to detect other points on the swing curve.

A wide variety of sensors are known in the art and do not need to be described in detail here. A wide variety of sensors can be used with this application including a position sensor that uses any type of light beam or irradiation source and a reflector such as a photoelectric, laser, infrared or related position sensors. Three different sizes of reflectors are attached to various spots on the club heads to provide different sensitivities, such as for the sensor with the smallest reflector having the highest sensitivity. The definition of highest sensitivity means the club head is closest to the space right above the sensor. The orientation sensor is used to measure how square the club head face is with respect to the target line at the moment the club head meeting the golf ball. The LED connected to the orientation sensor will light up if the deviation of the normal of the club head face with respect to the target line is within a preset value.

Another practice routine which is very helpful for a successful stroke is to try to swing the club head to make contact with a properly positioned elastic plastic ball holding plate in the vertically movable elastic plastic ball holder component. The position of the so called properly positioned elastic ball holding plate is located a slightly lower than the edge of the platform which is located a tiny bit to the right side of the golf ball or ball holding plate for a right handed golfer. In this exercise the left tip of the ball holding plate is barely exposed to and touchable by the club head in the swing. If the golfer can swing the club head clear of the edge of the platform and to make contact with the left edge of the elastic plastic ball holding plate which is properly sitting lower than the edge in every swing, the golfer is having very good control of the contacting spot of the club head with respect to the golf ball.

In a second embodiment of the present invention, the apparatus is an input apparatus for analyzing a golf swing. The major parts of the apparatus include a microprocessor, a ball for striking, an upper ball placed above the striking ball, and three or more swing sensors. The swing sensors detect the path of the golf club travel, the rotational speed of the striking ball, and also detect the golf club face orientation during impact. The position sensors, working together, detect the path and position of the club head. The microprocessor takes the information given by the sensors and processes the information using commonly available golf ball algorithms and sends the information to a display. The goal of the user is to find the perfect curve through practice on the driving range. The apparatus may be used in conjunction with the device of U.S. Pat. No. 6,554,716, the disclosure of which is incorporated herein by reference.

The device consists in general of an orientation sensor, some position sensors and a couple of movable balls. A special movable elastic plastic portion has an upper ball having the same function as a ball holding plate and ball holding arm and ball holding cylinder connector components similar to the ball holding component in U.S. Pat. No. 6,554,716 entitled "Swing For Accuracy". The present invention includes a movable hollow cylinder connector attached to the ball holding plate and ball holding arm to allow the ball holder to move up and down vertically inside the block.

Multiple position sensors are placed on both sides of the golf ball which is on the tee at a user adjusted position. These position sensors and the golf ball may form a line connecting the target to the golf ball to form a target line. The sensors are also positioned so that when the club head passes along the target line.

A variety of stick sensors act as position sensors and direction sensors. The stick sensors are numerous and oriented in an array such that each stick is a bristle of a brush. The stick sensors have an electronic pickup on the base to provide stroke input to the processor. The stick sensors are preferably mounted in slots to provide a more linear range of motion. Each stick sensor has a base electronic pickup which is wired to the processor. The slots are preferably rectangular. A first array of sticks, preferably a total of four sticks are mounted ahead of the ball. A second array of sticks preferably mounted behind the ball preferably provides a total of five sticks for measuring club action and speed. The club action is calculated by determining the time between contacting each stick. For example, the speed of the club is calculated by determining the time between the first stick sensor pickup activation and the second stick sensor pickup activation. The angle of the club can be determined by comparing the time between stick sensor pickup activation on the same array. For example, the angle of the club can be determined by comparing the first stick sensor pickup activation, the second stick sensor pickup activation, and the third stick sensor pickup activation or the last stick sensor pickup activation.

The stick sensors optionally have spring connection at a lower end. Optionally, the stick sensor can be made in a triple bristle configuration where a few bristles protrude from the stick base. After the microprocessor receives the information from the pickup, the microprocessor can calculate the type of swing. The swing parameters may then be output to a display, such as a bank of LED lights, or the output can be received by a video game golf simulator for calculating ball physics in the game.

In the third embodiment of the present invention, the golf swing trainer is a portable swing trainer. The third embodiment of the present invention may have a variety of components such as a carriage that three different heights of beam sensors can be mounted within. Different heights of beam sensors can provide adjustable swing path sensing. A carriage may have stick sensors mounted within. The portable configuration of the third embodiment of the present invention allows use on the field. Threaded sockets allow for threaded stick sensor mounting, and unthreaded sockets for stick sensor placement.

The third embodiment of the present invention provides a portable golf swing trainer that has a first configuration that is not portable, and a second configuration that is portable. The first mode includes a first slot, a second slot, a third slot and a fourth slot. As in the first embodiment, a ball target is disposed on a ball arm and the ball target rotates about a ball pivoting post. As before, the ball arm set screw can be used for adjusting the position of the ball arm and ball target. Other miscellaneous mechanisms are incorporated herein by reference from the previous disclosure. The first row of sensors has a first row first sensor and a first row second sensor mounted on a base.

Additionally, ramp mounted position sensors can be mounted before the fourth row sensors formed as sticks, and shown as a fourth row first stick sensor and a fourth row second stick sensor. The third row of sensors may be made as sticks, namely a third row first stick sensor and a third row second stick sensor. Similarly, the second row sensors can be made as sticks or beam sensors such as a second row first sensor and a second row second sensor.

In the portable mode of the third embodiment, a sensor carriage holds a plurality of position sensors. The sensor carriage can be mounted in the first slot in sliding configuration. The sensor carriage can be secured inside the first slot after adjustment. A user takes practice swings to determine a path, or a golf pro trainer adjusts the sensors so that the sensors define a path of desired swing. The desired path may activate an audio feedback such as a tone such as a chime, or a chord that is comprised of individual sensors activating different musical notes of a chord. In the best mode of the third embodiment, there are a total of eight sensors in use typically, with the ramp mounted position sensors preferably activated only in the portable configuration. A mesa is provided at the top of the ramp.

Each of the stick sensors and other sensors are preferably mounted within the carriage to provide left to right adjustment. The carriage shown is for a pair of stick sensors mounted on a pair of stick sensor pivoting hinges. One or more stick sensor pivot springs may restore the stick sensors to vertical position after a swing has hit the stick sensors to a prone position. The stick sensor carriage provides a module that is modularly interchangeable for another type of sensor. The carriage also allows left to right adjustment.

A restoring mechanism is preferably mounted behind the ramp, or on a carriage. Upon the carriage, the stick sensors can be moved closer to each other or away from each other by means of set screws located on stick sensor pivoting sleeves. Stick sensor pivoting sleeve set screws can secure the stick sensor pivoting sleeves to the horizontal pivot member at stick sensor pivoting sleeve ends. Preferably, there are a pair of stick sensors on a carriage and a pair of stick sensor pivoting sleeve ends for each stick sensor for a total of four stick sensor pivoting sleeve ends. Similarly, for each pair of stick sensor on a carriage there would be a pair of stick sensor pivoting sleeve set screws for a total of four stick sensor pivoting sleeve set screws. The restoring mechanism is preferably powered by helical springs that connect at one end to the stick sensor pivoting sleeves, and at another end to the base or stick sensor pivoting hinges.

The restoring mechanism preferably generally includes a pivoting connector that connects the stick sensor, which is typically vertical before being struck, to a horizontal pivot member. The pivoting connector may have a variety of features such as a stick sensor socket aperture on a socket. The socket aperture may have a threaded connection to a threaded portion of the stick sensor. The socket also would include a stick sensor socket body which could have an externally threaded periphery connecting to an internally threaded stick sensor bottom portion. A variety of stick sensors may have different connection configurations, such as a stick sensor plain bottom, a stick sensor tubular bottom, or a stick sensor laminated bottom. The stick sensor plain bottom is smooth, the stick sensor tubular bottom is threaded, and the stick sensor laminated bottom is formed by a pair of stick sensors laminated together.

The restoring mechanism preferably also includes a stick sensor pivot spring that pivots the stick sensor relative to the base. The stick sensor pivot spring connects at a stick sensor spring connection to the stick sensor pivot hinge for the purpose of maintaining the stick sensor in vertical position. The stick sensors may have a stick sensor threaded connection, may have a stick sensor tubular sheath, or a stick sensor helical section. The stick sensor sensing portion can be a brush, a single stick, or multiple sticks.

The position sensor carriage has a slot which is a position sensor slot that receives one or a number of position sensors mounted within the slot. The preferred usage of the sensor slot is to first position the position sensors within the slot, so that the relative position of the position sensors are fixed, then second to position the carriage within the carriage slot. The sensor carriages can be adjusted horizontally left and right and also vertically so as to create a swing path profile for a user by having all of the tips of the stick sensors in the swing path so that a user may repeatedly practice the same swing path.

The stick sensors can be automatically restored by the restoring mechanism and pivoting back to vertical position immediately after a swing has hit the stick sensors to a prone position, or the stick sensors can be retained in a prone position for swing analysis purposes. The catch mechanism for catching the stick sensors into a prone position may comprise a mechanical catch, or a magnetic catch. A mechanical catch mounted on a catch mount includes a catch slider that is pulled toward a catch solenoid when the solenoid is in energized state in the releasing position. The solenoid is more powerful than a catch slider spring which slides the catch slider back to catching position from the releasing position. The releasing position slides the catch retainer away from the stick sensor so that the stick sensor can be restored by the restoring mechanism to the vertical position. The catch retainer waits in catching position in the upward position and is biased downward when the stick sensor pivots downward. The stick sensor pushes past the catch retainer and the catch pivot spring restores the catch retainer back to the upward position such that the stick sensor is retained underneath the catch retainer until the solenoid is engaged for release. The amount of sliding travel can be adjusted by catch set screws. Instead of using electricity, a user could always pull or push the catch slider manually.

Alternatively, the catch mechanism can be magnetic such as an electromagnetic coil so as to magnetically retain a stick sensor that has sufficient magnetic material within it to engage with the catch mechanism that is magnetic. When the stick sensor is hit, the electromagnetic coil is in active state and will retain the stick sensor against it when the stick sensor strikes the magnetic coil. The magnetic coil can be cushioned with a spring so as to provide more contact time to make an engagement with the similarly magnetized stick sensor. In this case, the catch retainer can be mechanical or an electromagnetic coil. The catch mechanism is activated in both situations by an electrical switch shown in the drawings. The electrical actuator can be a push button or toggle switch.

The ramp in the preferred embodiment can be removed from the fourth slot so that the ramp and the restoring mechanism and the catch mechanism become a portable unit that a user can carry around for practice on a field such as a practice field. The portable ramp retains the same restoring mechanism and catch mechanism. The portable practice ramp is wedged shaped having a wedge body and optionally includes ramp mounted position sensors which can be used with or without the stick sensors behind the ramp. The ramp mounted position sensors are preferably mounted within a pair of depressions on the face of the ramp.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims.

OBJECTS OF THE INVENTION

A principal object of the present invention is to provide a golf training, practice, and coaching device that will overcome the deficiencies of the prior art devices.

An object of the present invention is to provide a golf training, practice, and coaching device that will show a user how square the club head face with respect to the target line thereby connecting the golf ball and the target at the moment the club head is impacting the golf ball. It allows the user to modify the swing accordingly if the deviation is greater than a preset value and the orientation sensor LED is not lighted up.

An object of the present invention is to provide a golf training, practice, and coaching device that will determine the form of the curve traced by the club head which triggers a few position sensors placed around the golf ball and near other segments of the curve such as the beginning or ending of the curve. If the position arrangement of the sensors is made correctly such as one made by a golf coach, the student's swing curve will change accordingly to trigger all the position sensors and the projectile of the golf ball will probably improve as a result. If the position sensor used is the beam source and reflector type, the sensitivity of the sensor is related to the size of the reflector. Three sizes of reflector will be used with the smallest size having the highest sensitivity and largest size with the lowest sensitivity. When the smallest size reflector triggers the sensor, the club head is moving pretty closely above the target line around the golf ball and produces a swing pretty close to the one by design.

An object of the present invention is to provide a golf training, practice, and coaching device that will help the golfer practice the swings which the club head makes contacts with the golf ball at the same spot repeatedly. This is done by properly selecting the height difference between the ball holding plate of the movable elastic plastic ball holder component and the surface of the platform so that the left tip of the ball holding plate is barely exposed to and touchable by the club head assuming the ball holding plate is placed very close to the platform horizontally.

Another object of the present invention is to provide a golf training, practice, and coaching device that will roughly measure the speed of the club head shortly before meeting the ball and after meeting the ball. The comparison of the time period between signal from the first sensor (the sensor on the right side of the ball for right handed player) and the signal from the orientation sensor when club head meeting the ball with the time period between the orientation sensor signal and the signal from the second sensor (the sensor on the left side of the ball for right handed player) will make you realize sometimes a smooth and easy down swing (especially at the beginning of the down swing) will produce more power and longer distance. A couple more position sensors mounted on the post stands will help monitor the club head path at the beginning of the down swing and provide more speed information regarding the earlier section of the down swing.

Another object of the present invention is to provide a golf training, practice, and coaching device that is more universally functional in today's market than the prior art devices.

OBJECTS OF THE INVENTION

The object of the invention is to provide an improved golf swing trainer.

BRIEF DESCRIPTION OF THE DRAWINGS

FIG. 6Ai is a perspective view of the stick sensor configuration before a pure strike.

FIG. 6Aii is a top view of the electronic sensor configuration before a pure strike.

FIG. 6Aiii is a top view of the stick sensor configuration after a pure strike.

FIG. 6Bi is a perspective view of the stick sensor configuration before a stroke causing a slice.

FIG. 6Bii is a top view of the electronic sensor configuration before a stroke causing a slice.

FIG. 6Biii is a top view of the stick sensor configuration after a stroke causing a slice.

FIG. 6Ci is a perspective view of the stick sensor configuration before a stroke causing a hook.

FIG. 6Cii is a top view of the striking row sensor configuration before a stroke causing a hook.

FIG. 6Ciii is a top view of the striking row sensor configuration after a stroke causing a hook.

FIG. 8A is a diagram of the third row of sticks sensors with two sockets behind the protective slope.

FIG. 8B is a diagram of the third row of sticks sensors with one socket behind the protective slope.

FIG. 8C is a diagram of the third row of sticks sensors with one socket behind the protective slope.

FIG. 10 shows a variety of top views of sensor configurations.

FIG. 10A shows a variety of top views of stick sensor configurations.

FIG. 10B shows a variety of top views of the electronic beam sensor configurations.

FIG. 12 shows a variety of components.

FIG. 13 shows a variety of different stick sensor configurations similar to FIG. 9.

FIG. 14 shows a variety of catch mechanisms and stick sensor connection methods.

FIG. 15 shows a variety of mechanical restoring mechanisms and stick sensor configurations.

FIG. 17 is a perspective view diagram of the present invention, showing that the first row and second row are both beam sensors.

Figure 1:
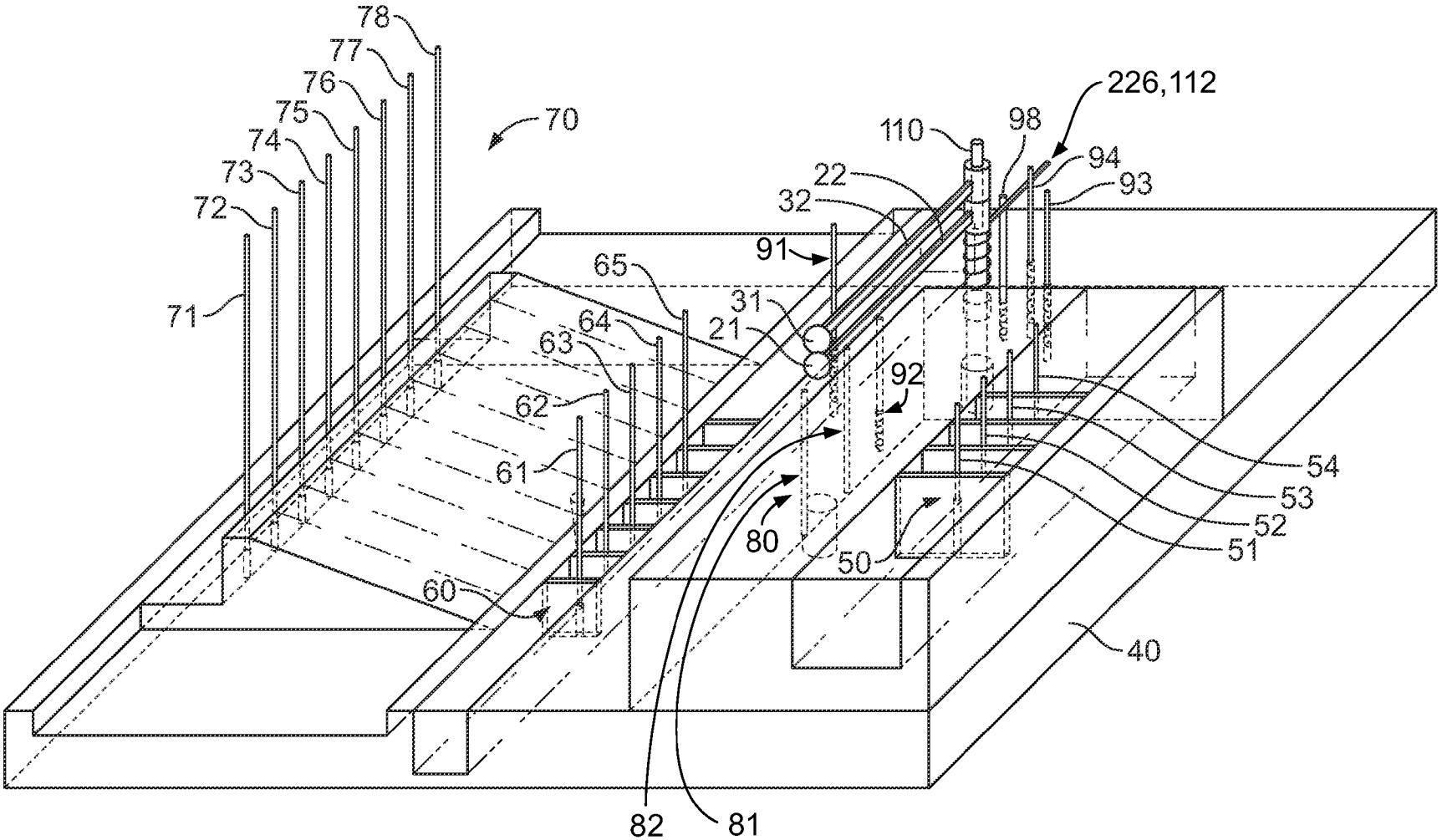
FIG. 1 is an isometric view of the present invention first embodiment.

Because of the number of callout elements, a list of callout elements is provided for user reference as follows for the first and second embodiment:

Lower Ball 21
First Row Of Stick Sensors 50
First Row First Stick Sensor 51
First Row Second Stick Sensor 52
First Row Third Stick Sensor 53
First Row Fourth Stick Sensor 54
Second Row Of Stick Sensors 60
Second Row First Stick Sensor 61
Second Row First Slot 361
Second Row Second Stick Sensor 62
Second Row Second Slot 362
Second Row Third Stick Sensor 63
Second Row Third Slot 363
Second Row Fourth Stick Sensor 64
Second Row Fourth Slot 364
Second Row Fifth Stick Sensor 65
Second Row Fifth Slot 365
Second Row Empty Slot 366
Second Row Last Slot 367
Second Row Slots 388
Third Row Of Stick Sensors 70
Third Row Sockets 370
Third Row First Stick Sensor 71
Third Row First Socket 371
Third Row Second Stick Sensor 72
Third Row Second Socket 372
Third Row Third Stick Sensor 73
Third Row Third Socket 373
Third Row Fourth Stick Sensor 74
Third Row Fourth Socket 374
Third Row Fifth Stick Sensor 75
Third Row Fifth Socket 375
Third Row Sixth Stick Sensor 76
Third Row Sixth Socket 376
Third Row Seventh Stick Sensor 77
Third Row Seventh Socket 377
Third Row Eighth Stick Sensor 78
Third Row Eighth Socket 378
Striking Row 80
Striking Row Inside Stick Sensor 81
Striking Row Outside Stick Sensor 82
Upper Ball 31
Upper Ball Arm 32
Upper Ball Retainer 210
Upper Threaded Opening 212
Set Screw 211
Shaft Axis 110
Helical Spring 230
Lower Ball Retainer 220
Lower Ball 21
Lower Ball Arm 22
Spring Receiving Opening 229
Spring Retaining Thread 228
Spring Retainer Set Screw 227
Lower Threaded Opening 224
Pin 223
Retainer Spring 222
Lower Set Screw 221
Threaded Mounting 225
Horizontal Stop Bar 226
Bottom Retainer 240
Lower Spring Opening 243
Bottom Spring Set Screw 244
Bottom Retainer Set Screw 241
Bottom Retainer Set Screw Thread 242
Ball Striking Assembly Base 245
Threaded Hole 248
Base 40
Higher Flat Surface 41
Inclining Surface 42
Lower Surface 43
Supporting Ball Device 2
Block 10
Slot 11
Bulbous End 111
Rotation Stopper 98
First Rotational Stick Sensor 91
Second Rotational Stick Sensor 92
Third Rotational Stick Sensor 93
Fourth Rotational Stick Sensor 94
First Electronic Position Sensor 191
Second Electronic Position Sensor 192
Third Electronic Position Sensor 193
Fourth Electronic Position Sensor 194
Striking Row Inside Position Sensor 181
Striking Row Outside Position Sensor 182
First Row Position Sensors 150
First Row Inside Position Sensor 151
First Row Outside Position Sensor 152
Second Row Inside Position Sensor 161
Second Row Outside Position Sensor 162

Because of the number of callout elements, a list of callout elements is also provided for user reference as follows for the third embodiment:

400 Portable Golf Swing Trainer
401 Fourth Slot
402 Third Slot
403 Second Slot
404 First Slot
410 Ball Pivoting Post
411 Ramp Mounted Position Sensor
421 Ball Target
422 Ball Arm
425 Stick Sensor Pivoting Sleeve
426 Stick Sensor Pivoting Sleeve Set Screw
427 Stick Sensor Pivoting Sleeve End
430 Restoring Mechanism
431 Stick Sensor Pivot Hinge
432 Pivoting Connector
433 Stick Sensor Socket Aperture
434 Stick Sensor Socket Body
435 Stick Sensor Pivot Spring
436 Stick Sensor Plain Bottom
437 Stick Sensor Tubular Bottom
438 Stick Sensor Laminated Bottom
439 Stick Sensor Spring Connection
440 Base
450 Sensor First Row
451 First Row First Sensor
452 First Row Second Sensor
460 Third Row Of Sticks Sensors

461 Third Row First Stick Sensor
462 Third Row Second Stick Sensor
465 Horizontal Pivot Member
466 Stick Sensor Threaded Connection
467 Stick Sensor Tubular Sheath
468 Stick Sensor Helical Section
469 Stick Sensor Sensing Portion
470 Fourth Row Of Sticks Sensors
471 Fourth Row First Stick Sensor
472 Fourth Row Second Stick Sensor
480 Second Row Sensors
481 Second Row First Sensor
482 Second Row Second Sensor
483 Mesa
485 Stick Sensor Carriage
486 Position Sensor Carriage
487 Position Sensors
488 Ramp
489 Position Sensor Slot
490 Catch Mechanism
491 Catch Slider
492 Catch Set Screws
493 Ball Arm Set Screw
495 Catch Solenoid
496 Catch Slider Spring
497 Catch Retainer
498 Catch Pivot Spring
499 Catch Mount

DETAILED DESCRIPTION OF THE PREFERRED EMBODIMENT

The present invention utilizes stick sensors which are arranged in arrays or rows. As seen in FIG. 1, the first row 50 is comprised of a first row first stick sensor 51, a first row second stick sensor 52, a first row third stick sensor 53, and a first row fourth stick sensor 54. The next row of stick sensors is preferably the striking row 80 which are mounted in collinear configuration with the front edge of the lower ball 21. The striking row 80 has a striking row inside stick sensor 81 to the left side of the lower ball 21 and a striking row outside stick sensor 82 to the right of the lower ball 21. The second row of stick sensors 60 includes a second row first stick sensor 61, a second row second stick sensor 62, a second row third stick sensor 63, a second row fourth stick sensor 64, and a second row fifth stick sensor 65. The third row of stick sensors 70 includes a third row first stick sensor 71, a third row second stick sensor 72, a third row third stick sensor 73, a third row fourth stick sensor 74, a third row fifth stick sensor 75, a third row sixth stick sensor 76, a third row seventh stick sensor 77, and finally an third row eighth stick sensor 78. Therefore, a total of four rows are implemented for recovering data on club speed, club path and club orientation.

Figure 3:
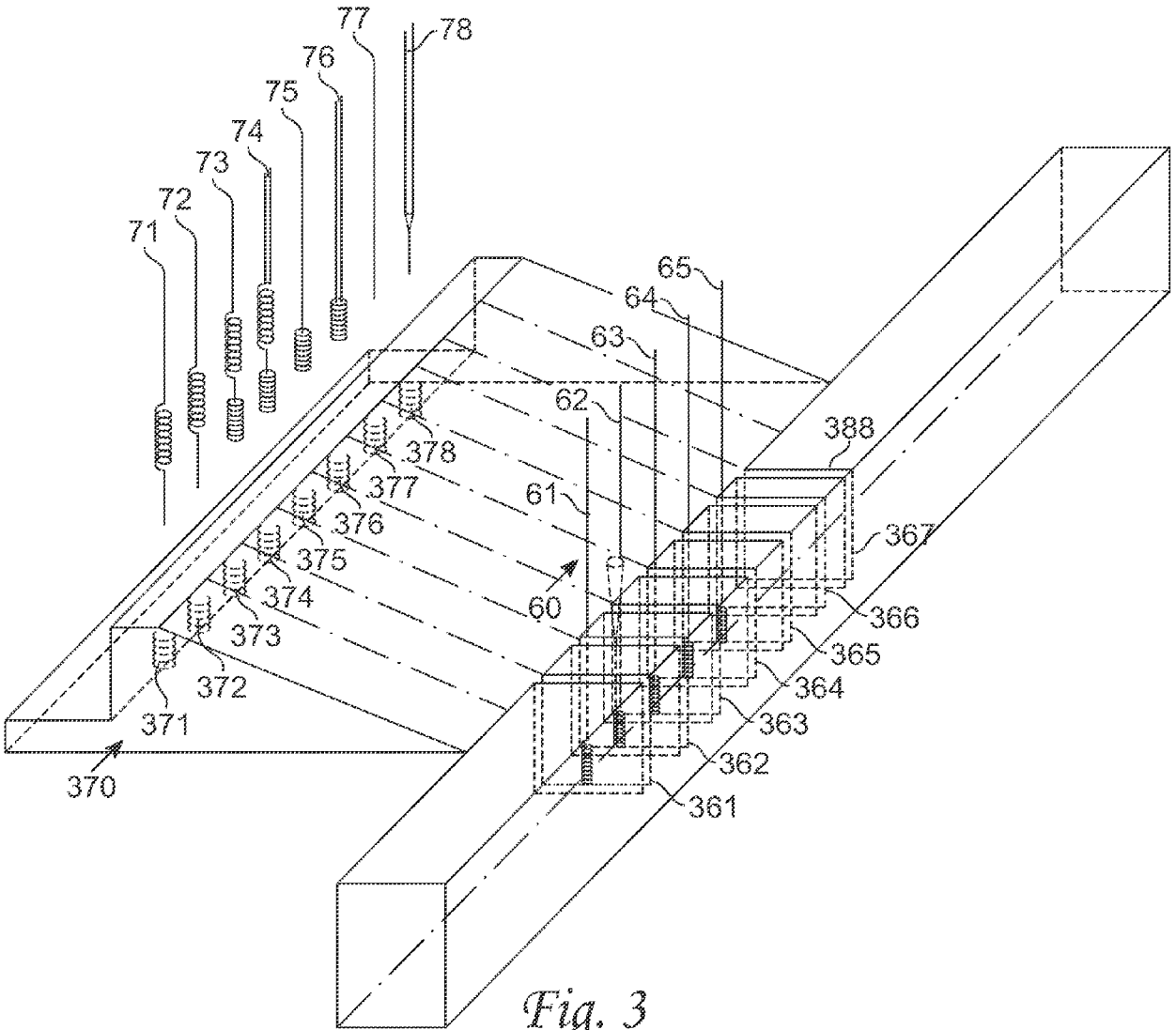
FIG. 3 is a diagram of two arrays of stick sensors.

The stick sensors are mounted within slots. For example, as seen in FIG. 3, the second row of stick sensors 60 have stick sensors mounted within slots. The second row first stick sensor 61 is mounted within a second row first slot 361. The second row second stick sensor 62 is mounted within the second row second slot 362. The second row third stick sensor 63 is mounted within the second row third slot 363. The second row fourth stick sensor 64 is mounted within the second row fourth slot 364. The second row fifth stick sensor 65 is mounted within the second row fifth slot 365. An empty second row slot 366 may optionally receive a beam sensor. The last second row slot 367 optionally allows a cone shaped sensor. The beam sensor and the cone shaped sensor may both receive a signal when activated for detecting club head path. The plurality of second row slots 388 are preferably aligned in a row such that regular interval spacing provides a uniform configuration.

Also shown in FIG. 3 are third row sockets for receiving stick sensors. The third row sockets 370 include the third row first socket 371, the third row second socket 372, the third row third socket 373, the third row fourth socket 374, the third row fifth socket 375, the third row sixth socket 376, the third row seventh socket 377, and the third row eighth socket 378.

Figure 2:
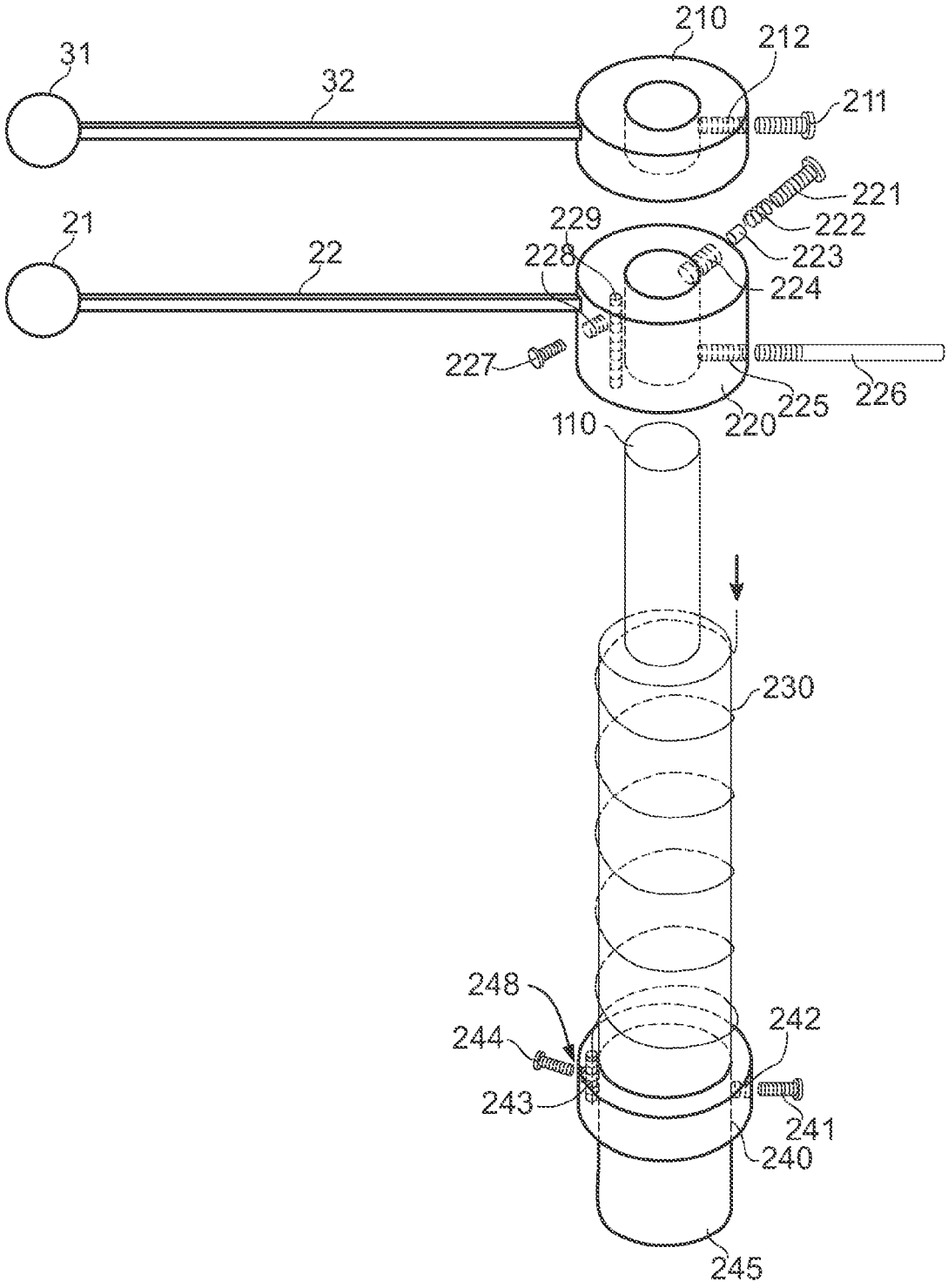
FIG. 2 is a diagram of components for the lower ball and upper ball assembly.

The ball striking assembly as a configuration that includes an upper ball 31 mounted on an upper ball arm 32 which in turn is mounted to an upper ball retainer 210, FIG. 2. The upper ball retainer 210 assumes the shape of a bearing which has an upper threaded opening 212 for receiving a set screw 211. The set screw has adjustable securing of the upper ball retainer 210 to the shaft axis 110. The shaft axis 110 has a helical spring 230 mounted around. The helical spring has an upper end denoted by an arrow. The upper end of the helical spring is connected to the lower ball retainer 220. The lower ball 21 is mounted on the lower ball arm 22 which is in turn mounted to the lower ball retainer 220. The lower ball retainer 220 may have an upper spring receiving opening 229 vertically disposed for receiving the vertically disposed upper end of the helical spring 230. The vertically disposed upper spring receiving opening 229 may have a spring retaining thread 228 receiving a spring retainer set screw 227. When spring retainer set screw 227 is engaged, it locks to the vertically disposed upper spring receiving opening 229 and retains the upper vertical portion of the helical spring 230. When the ball striking assembly is assembled, the helical spring biases the lower ball into a restored position for multiple strokes. The helical spring may further support the upper ball retainer 210 and the lower ball retainer 220 to maintain the lower ball in striking position. The lower ball retainer 220 may further have a lower threaded opening 224 for receiving a pin 223 and a retainer spring 222 with a lower set screw 221. The lower ball retainer may also have a threaded mounting 225 for receiving a horizontal limit stop bar 226 which also operates as a rotational range indicator. The pin 223 may act as a braking pad instead of a set screw.

A bottom retainer 240 supports the helical spring 230. The helical spring 230 has a bottom end which protrudes downward vertically into lower spring opening 243. The lower spring opening 243 is vertically oriented and has a bottom spring set screw 244 (through threaded hole 248) securing the lower end of the helical spring 230 with the bottom retainer 240. Also, the bottom retainer 240 is secured to the shaft axis 110 by a bottom retainer set screw 241 passing through a bottom retainer set screw thread 242. The ball striking assembly base 245 is disposed as a cylinder for installing into a circular opening in the base 40. The above preferred embodiment of the ball striking assembly may not necessarily be the only possible embodiment.

Figure 4:
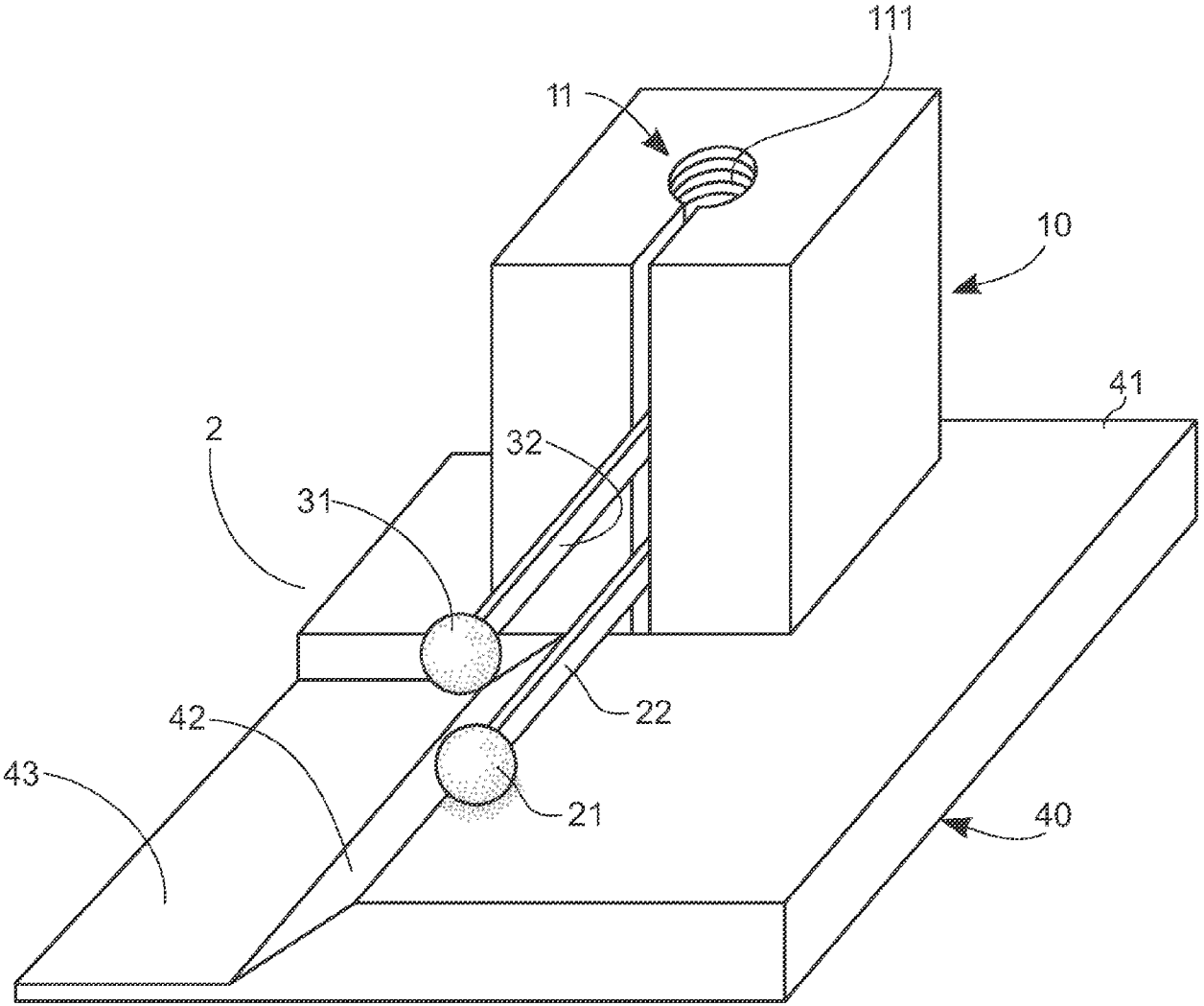
FIG. 4 is an alternate embodiment of the lower ball and upper ball assembly.

As an alternate embodiment of the ball striking assembly can be seen in FIG. 4, and also described in detail in U.S. Pat. No. 6,554,716 to Loh entitled Golf Swing For Accuracy Mat, the disclosure of which is incorporated herein in its entirety by reference. Generally, the alternative embodiment ball striking assembly includes a base 40 in the shape of a mat with a higher flat surface 41 and inclining surface 42 with a lower surface 43. The supporting ball device 2 can have a block 10 holding the practice arms within a slot 11. The slot may have a bulbous end 111. For further details relating to the invention, one may refer to the issued patent disclosure. Although the alternate embodiment provides an adequate ball striking assembly, the preferred embodiment should be used.

Figure 5:
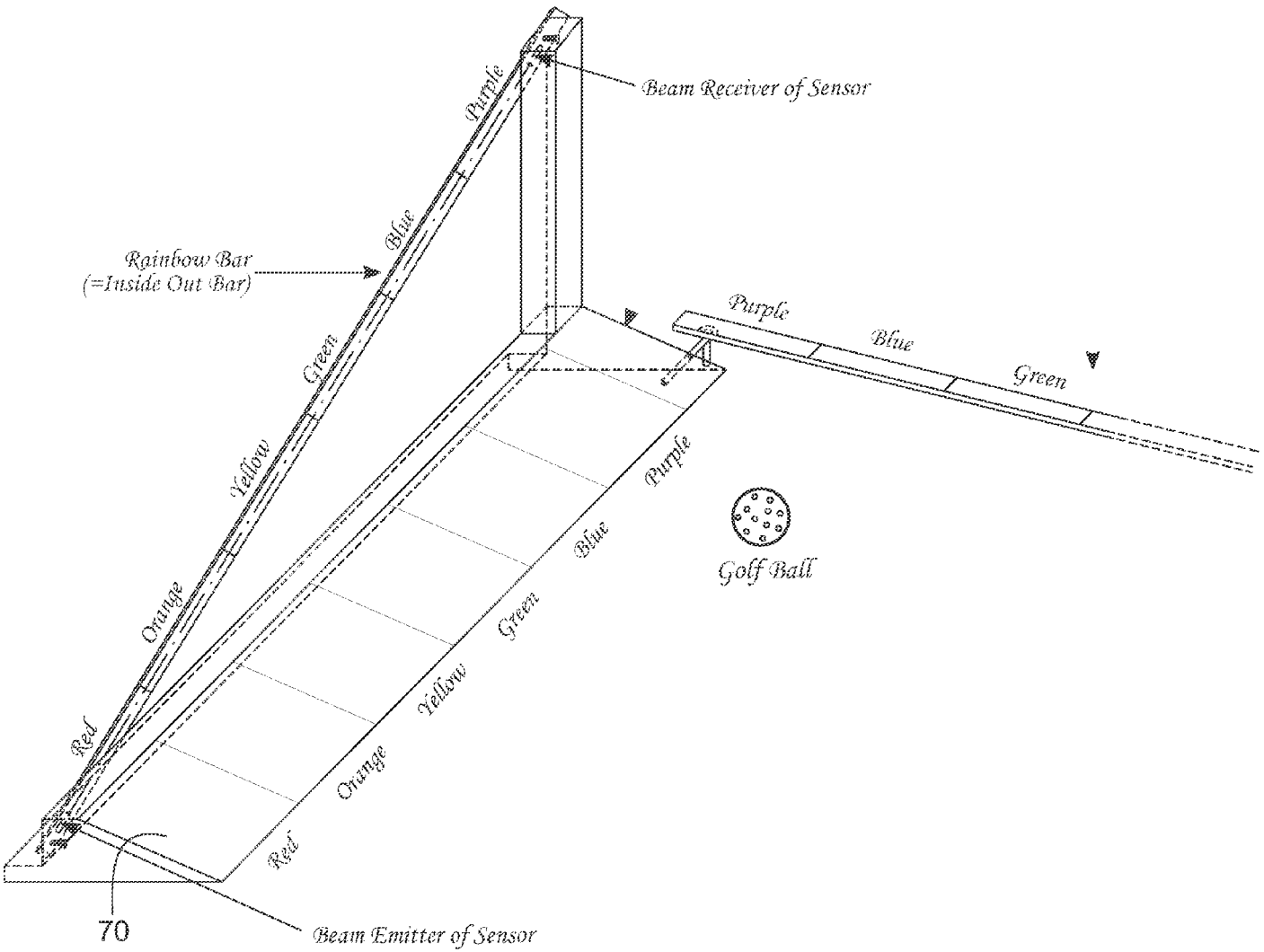
FIG. 5 is a diagram of the rainbow bar.

A helpful tool for beginners, FIG. 5, is a follow-through guide that may include a rainbow bar which is temporarily placed on a post. The rainbow bar preferably includes a red, orange, yellow, green, blue and purple band aligned with the similar color band on the protective slope surface. The rainbow bar has a lower end, and a higher end resting on a post to form an isosceles triangle. The protective slope surface has color bands of red, orange, yellow, green, blue and purple for coordinating visual association of the swing with the rainbow bar. When actually striking the ball, the bar is removed and placed to the side. A beam emitter and beam receiver provides a follow-through zone. The follow-through zone is defined by the isosceles right triangle configuration. When a user swings through, the user associates the color of the bar, and the color of the band on protective slope surface with user muscle memory. The follow-through guide further includes an audible feedback for receiving immediate feedback. A speaker element can play a tone when the user follows through. The tone and color of the follow-through guide provide a reference for beginners. The rainbow bar tool can be used in conjunction with the ball striking assembly, or the other elements of the invention. The protective slope surface is preferably at the location of the third row of sensors which is about one and a half feet behind the striking row. The follow-through guide can also replace the third row of position sensors and provide only one musical note when the club head interrupts the beam from the emitter to the receiver. The other musical notes are provided by the triggered position sensors in the first row, striking and the second row to form a musical tune which characterizes the swing curve.

Figure 6:
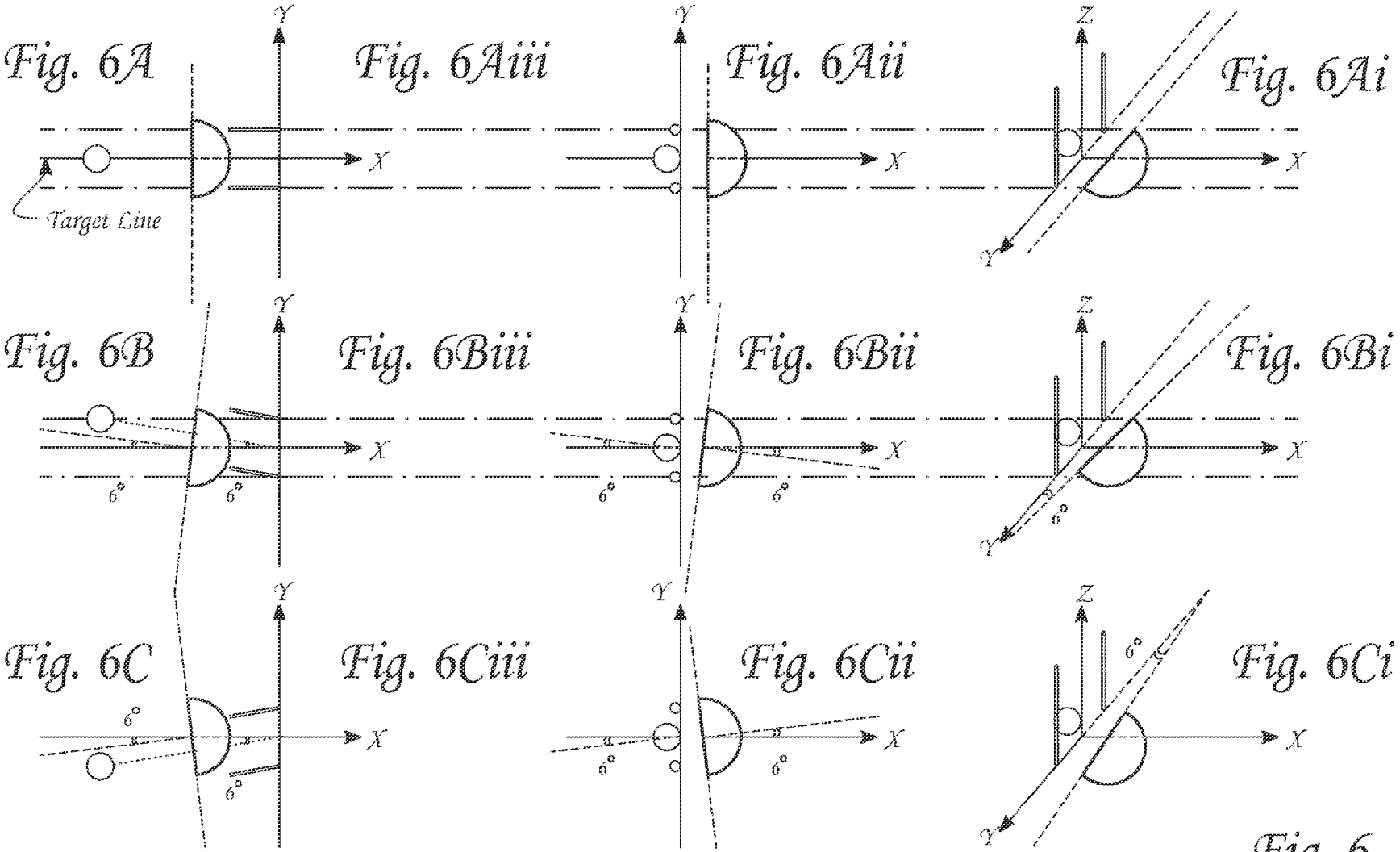
FIG. 6A-FIG. 6C are diagrams of the striking row sensor configuration.

The present invention provides a number of configurations for the striking row sensors. Preferably, a pair of sensors on the striking row, namely a left sensor and a right sensor provide information regarding the orientation of the clubface during the striking of the ball. FIG. 6 shows the club moving along the X-axis from the right side of the golf ball to the left side of the golf ball. The golf ball is sitting on the X-axis with its right tip above the origin of the coordinates. The X-axis is coinciding with the target line which connects the target to the golf ball. FIG. 6Ai is a perspective view of the stick sensor configuration before a pure strike. In this configuration, the pair of stick sensors register at the same time and send a signal showing that no time difference exists between the sensors. FIG. 6Aii is a top view of the electronic sensor configuration before a pure strike. The top view shows that the clubface is flush with the line formed between the sensors and the face of the ball. FIG. 6Aiii is a top view of the stick sensor configuration after a pure strike. The stick sensors are pushed downward and are parallel to the striking of the golf ball.

The pair of sensors on the striking row also detect an angular deviation which causes a slice if the user rotates the clubface so that it is not parallel to the stick sensor line. FIG. 6Bi is a perspective view of the stick sensor configuration before a swing having a deviation causing a slice, hereafter abbreviated as and called a 'slice'. Here, the angle of the slice is approximately 6° from the line of club head travel. The club contracts the inside sensor before the outside sensor, assuming that a right-handed stroke is in progress. The processor compares the signal time between the first row of sensors and the striking row of sensors to calculate the club speed. The processor then compares the time difference between each sensor on the striking row to calculate the amount of angular aberration. FIG. 6Bii is a top view of the electronic sensor configuration before a slice. The top view shows that a 6° slice is in progress. FIG. 6Biii is a top view of the stick sensor configuration after a slice. The stick sensors can be oriented so that they remain prone after being struck. The stick sensors can then provide a user with a visual cue as to the degree of slice. The stick sensors can be mounted on a ball assembly joint so that they rotate freely at the base. The stick sensor ball assembly joint is underneath the top surface of the base 40 so that it is not struck by the club. Stick sensors can optionally be mounted so that they automatically restore to original position. Some stick sensors can be mounted to stay down and provide the user with a visual cue while other stick sensors can be mounted to automatically restore. It is preferred that the striking row stick sensors are mounted with a ball joint at their base so that they remain prone temporarily for user feedback. The ball joint on the base of the stick sensors further includes a biasing dimple for restoring the stick sensor back to perfectly vertical position. FIG. 6Ci is a perspective view of the stick sensor configuration before a swing having an angular deviation causing a hook, hereafter abbreviated and called a 'hook'. In this situation, the hook contacts the outside stick sensor first, and the inside stick sensor second. FIG. 6Cii is a top view of the striking row sensor configuration before a hook. The angle of the hook is shown as 6° and is in progress. FIG. 6Ciii is a top view of the striking row sensor configuration after a hook. The preferred striking row stick sensors are mounted on a ball joint at their base to provide manual restoration after a user views the stick sensor position as a guide for determining the angle of hook. A user may thus have a visual cue for determining the amount of hook or slice. The visual cue is in conjunction with electronic feedback from data captured when each stick sensor is struck. The stick sensor produces an electronic output when struck. The processor can compare the times between the electronic outputs to calculate angular aberration. Thus, the user has angular aberration as well as the visual cue for reference in training stroke habits.

As an optional embodiment, the configuration of the beam emitter and the beam receiver can be made detachable so that they can be used separately and independently apart from the other elements of this invention. The follow-through guide placed at a proper spot between the golf ball and the target can help the golfer swing with the club head moving along an inside and out route around the golf ball. The club head can be moving as far as possible along the target line for longer follow through and consistently moving along the same route relative to the golf ball so that the trajectory of the golf ball is more consistent along the target without a slice or hook. In FIG. 7A, a user uses a rainbow bar also called an inside out bar for providing a visual cue. The user can use the colors on the bar to provide a visual cue for training a practice swing. The target line denotes the path of the club head during the practice swing. As the user makes an actual swing, the club head passes through the beam when a stroke is proper. The user can rotate the rainbow bar or move it before during or after the practice swing as the user sees fit.

Figure 7:
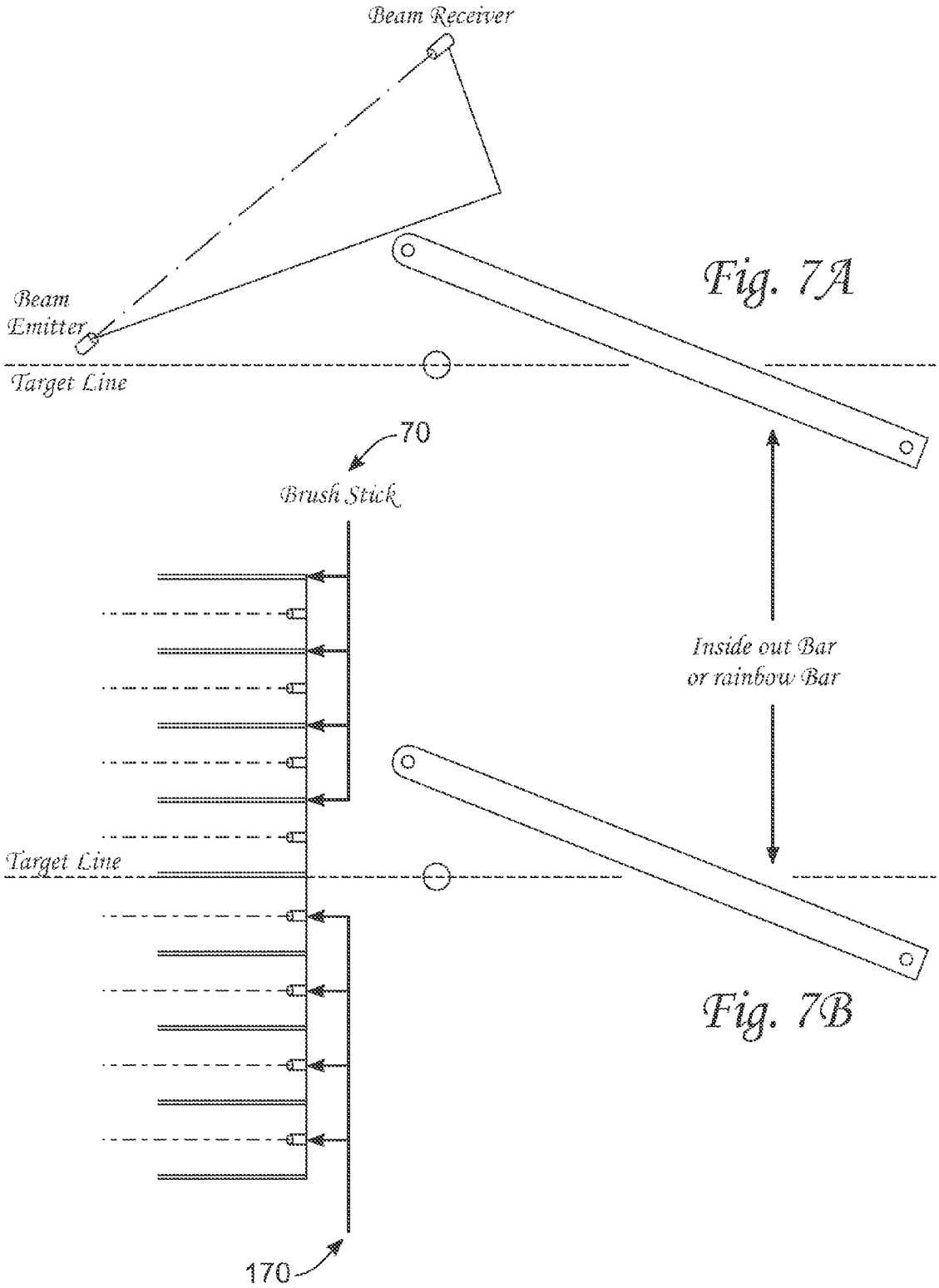
FIG. 7*a* is a diagram of the components for using the rainbow bar and emitter receiver through beam sensor with protective slope in relation to the target line.
FIG. 7*b* is a diagram of the components for using the rainbow bar with the third row of stick sensors and electronic position sensors behind the protective slope.

The optional embodiment training technique can also be used with an alternating array of stick sensors 70 alternating between beam sensors 170, FIG. 7. The stick sensors can be formed as brushes with bristles. The beam sensors 170 and brush sensors can both provide visual and audible feedback immediately. The feedback can be visual with LED lights or audible with tones. Each of the beam sensors or brush sensors can provide a different tone. The tones may form musical notes such that striking of multiple sensors creates a chord or other musical melody which the user can then associate with muscle memory. The musical melody may be derived from a contact between the club head and the position sensors in the first row, striking row, second row, and third row.

As yet another optional embodiment as seen in FIG. 8, the base 40 can be miniaturized into a small wedge for backyard practice such as chipping practice. The small wedge may receive a row of rear brush sticks. The brush sticks are preferably made of a metal material having resilience. When the rear row of brush sticks is hit, each can be tuned to a different sound or light so that a user may associate the brush stick activation pattern with a stroke. The rear brush sticks are mounted on a spring to provide a follow-through confirmation. A single or plurality of circular aperture sockets receive the brush sticks. Optionally, a pair of protruding stakes secure the wedge to the ground. The wedge may have a rectangular footprint as shown in FIG. 8A, a slim rectangular footprint as shown in FIG. 8B or a triangular footprint as shown in FIG. 8A. The optional embodiment can be used once the user has improved. Eventually, it is preferred that the user may practice and develop to a consistent swing without need for practice apparatus aids.

Figures 9, 9A, 9B, 9C, 9D, 9E, 9F, 9G, 9H, 9I:
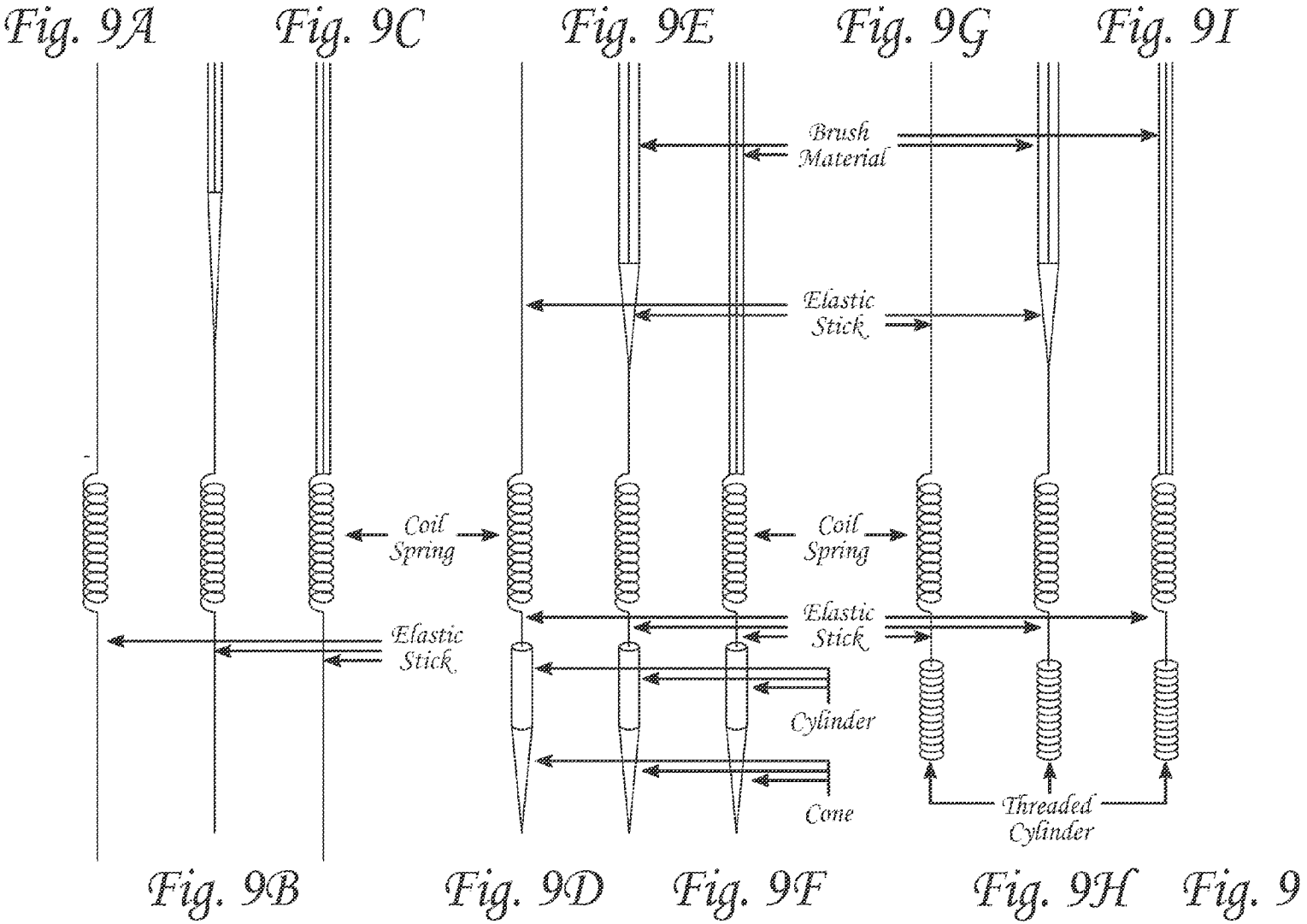
FIG. 9 shows different stick sensor configurations.
FIG. 9A is a diagram of a stick sensor configuration.
FIG. 9B is a diagram of a stick sensor configuration.
FIG. 9C is a diagram of a stick sensor configuration.
FIG. 9D is a diagram of a stick sensor configuration.
FIG. 9E is a diagram of a stick sensor configuration.
FIG. 9F is a diagram of a stick sensor configuration.
FIG. 9G is a diagram of a stick sensor configuration.
FIG. 9H is a diagram of a stick sensor configuration.
FIG. 9I is a diagram of a stick sensor configuration.

FIG. 9 shows different stick sensor configurations. FIG. 9A is a diagram of a stick sensor configuration which has an elastic stick bottom with a spring in the middle and a single bristle top. FIG. 9B is a diagram of a stick sensor configuration which has an elastic stick bottom with a coiled spring middle and a single bristle midsection which extends to a multiple bristle top. FIG. 9C is a diagram of a stick sensor configuration which has an elastic stick bottom with a coiled spring middle and a bristle stick top extending from the coiled spring middle. FIG. 9D is a diagram of a stick sensor configuration having a cone weighted bottom with a cylindrical base body above the cone weighted bottom and a coiled spring middle terminating in an elastic stick top. FIG. 9E is a diagram of a stick sensor configuration having a cylindrical base body above a cone weighted bottom with a coiled spring middle and brush bristle top with intermediate elastic stick. FIG. 9F is a diagram of a stick sensor configuration with a cone weighted bottom and a cylinder above the cone with an elastic stick intermediate portion and a coil spring middle terminating in brush material above. FIG. 9G is a diagram of a stick sensor configuration with a threaded cylinder bottom and elastic stick middle having an elastic stick top and a coil spring middle. FIG. 9H is a diagram of a stick sensor configuration having a threaded cylinder bottom and elastic stick middle a coiled spring middle and a brush top with intermediate elastic stick between the brush top and coil spring. FIG. 9I is a diagram of a stick sensor configuration with a threaded cylinder bottom, an elastic stick above the threaded cylinder, a coiled spring above the elastic stick and brush material extending from the coiled spring.

Each of the different stick sensor configurations can be used in the present invention. The elastic stick bottom can be mounted directly in the base 40. The cylinder and cone bottom can form a spike for inserting into ground. The threaded cylinder can be threadedly connected to the base 40. An alternate embodiment for the stick sensor bottom connection is to connect the stick bottom, or the threaded cylinder to a ball joint installed in the base 40. The ball joint receives a degree of motion for maintaining the stick sensor in prone position when struck so that the user can see the path of the golf club head.

FIG. 10A-B shows a top view of the present invention. The ball is mounted to a shaft axis 110 which has a horizontal stop bar 226 forming a rotational range indicator 112. The rotation stopper 98 is a vertical shaft stopping the rotation of the rotational range indicator 112. Rotational stick sensors comprise a third rotational stick sensor 93, and a fourth rotational stick sensor 94. The rotational range indicator 112 provides an indication of the strength of the impact between the lower ball which is the target and the club head. Supplemental rotational stick sensors can also be mounted in parallel so that a second rotational stick sensor 92 can be mounted in front of the ball target, with a first rotational stick sensor 91 further behind the second rotational stick sensor 92 in front of the ball target. The club head speed can be calculated from the time differential between the activation of the different stick sensors among the rotational stick sensors. As stated before, the stick sensors at the striking row 80 include an outside stick sensor 82 and an inside stick sensor 81. The first striking row 50 includes a first row first stick sensor 51, a first row second stick sensor 52, a first row third stick sensor 53, and a first row fourth stick sensor 54. The time differential between the stick sensors can be used by the processor for modeling ball speed, ball path and other parameters. The brush and coil spring style stick means 113 for measuring rotational speed of the rotational range indicator is the preferred method.

FIG. 10B provides an electronic version of the stick sensor embodiment. The rotation range indicator 112 remains mechanical and the rotation stopper 98 also remains mechanical, however the position sensors for measuring rotation speed are substituted with electronic beam sensors that sense position similar to the stick sensor. A first position sensor 191 and a second position sensor 192 in conjunction with a third position sensor 193 with a fourth position sensor 194 provide input to a processor for determining the strength and speed of the club strike on the ball. Striking row inside position sensor 181 and striking row outside position sensor 182 can be mechanical or electronic. The preferred embodiment is to have a mechanical stick sensor configuration for the inside position sensor 81 and the outside position sensor 82 so that a user may strike the ball and see the stick sensor immediately afterwards. On the other hand, it is also possible to have an electronic embodiment of the inside position sensor 181 and the outside position sensor 182.

A pair of first row position sensors for club head path tracking 150 may comprise a first row inside position sensor 151 and a first row outside position sensor 152. The position sensors for tracking the club path may include a second row of position sensors including second row inside position sensor 161 and a second row outside position sensor 162.

The apparatus is primarily an input device, but can also function in conjunction with virtual golf accessories, such as console games. The input device can be an input device for a personal computer or console game. The input device can also be a standalone apparatus having simple visual or audio feedback such as tones or blinking lights which may or may not be used with virtual golf games.

Figure 11:
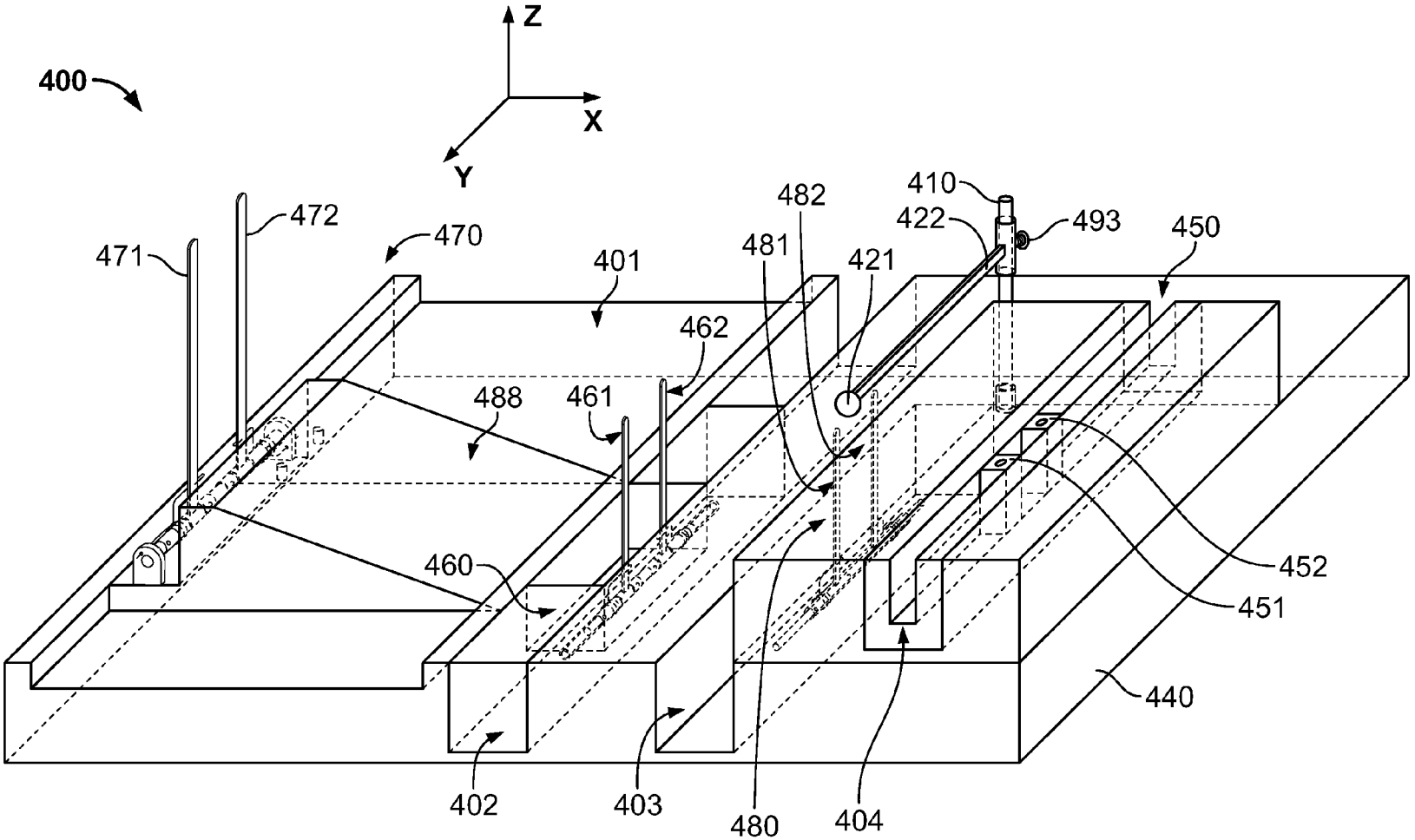
FIG. 11 is a diagram of the third embodiment of the present invention.
Figure 12A:
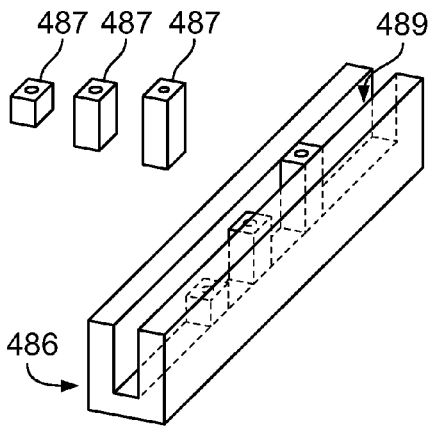
FIG. 12A is a diagram of a carriage showing that three different heights of beam sensors can be mounted within the carriage
Figure 12C:
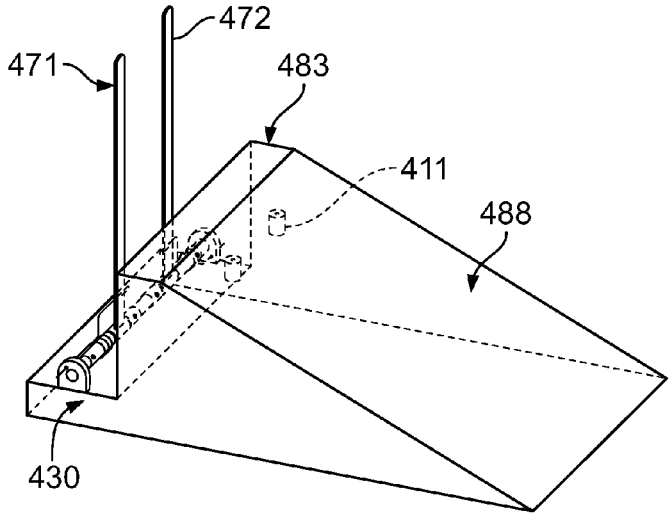
FIG. 12C is a perspective view of the portable configuration of the third embodiment of the present invention.
Figure 12B:
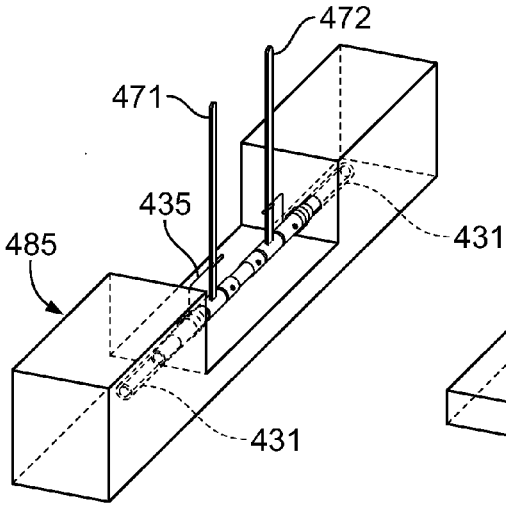
FIG. 12B is a diagram of a carriage showing stick sensors mounted within.
Figure 12D:
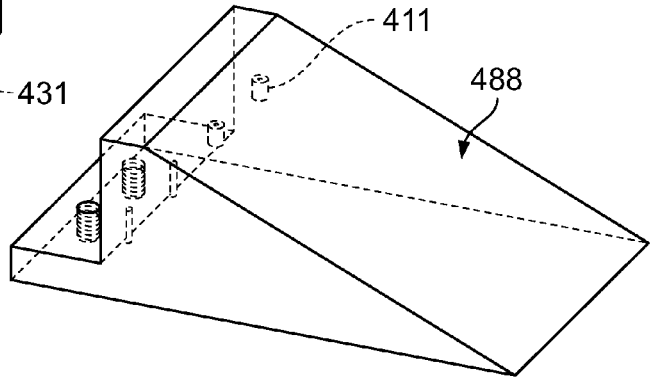
FIG. 12D is a perspective view of the present invention showing threaded sockets for thread stick sensor mounting, and unthreaded sockets for stick sensor placement.
Figures 13A, 13B, 13C, 13D, 13E, 13F, 13G, 13H, 13I:
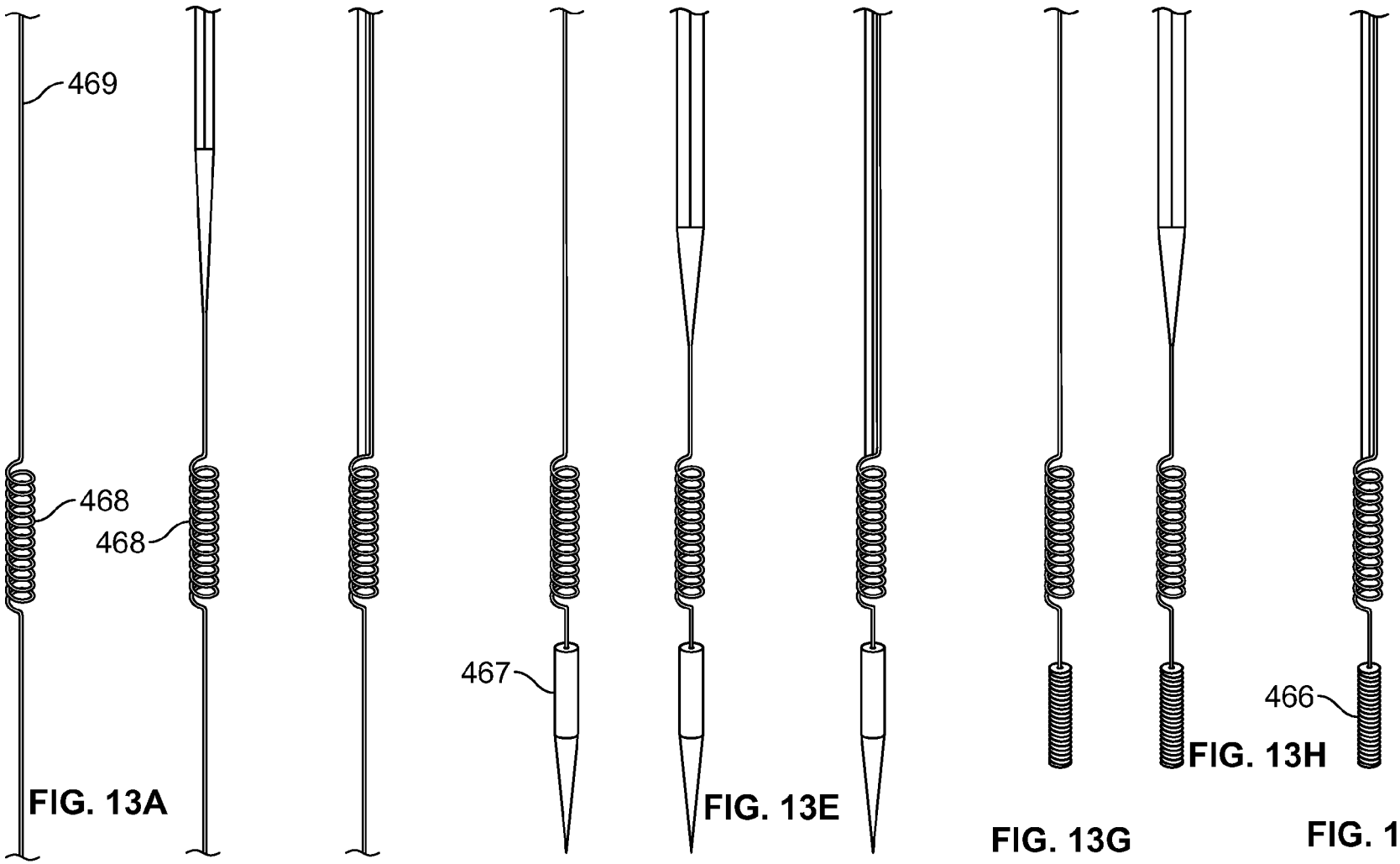
FIG. 13A is a diagram of a stick sensor configuration.
FIG. 13B is a diagram of a stick sensor configuration.
FIG. 13C is a diagram of a stick sensor configuration.
FIG. 13D is a diagram of a stick sensor configuration.
FIG. 13E is a diagram of a stick sensor configuration.
FIG. 13F is a diagram of a stick sensor configuration.
FIG. 13G is a diagram of a stick sensor configuration.
FIG. 13H is a diagram of a stick sensor configuration.
FIG. 13I is a diagram of a stick sensor configuration.
Figure 14A:
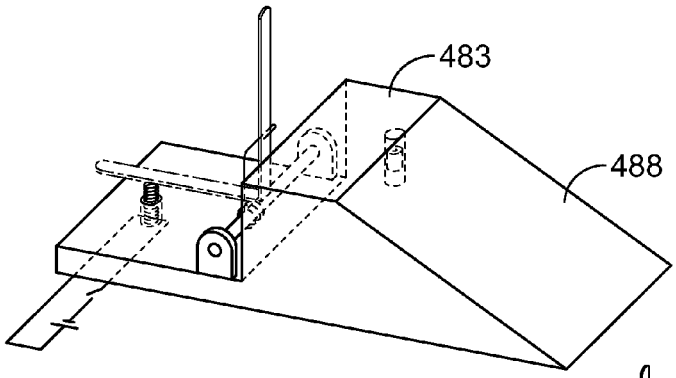
FIG. 14A is a perspective view of an electromagnetic catch with a single beam sensor mounted in the wedge.
Figure 14B:
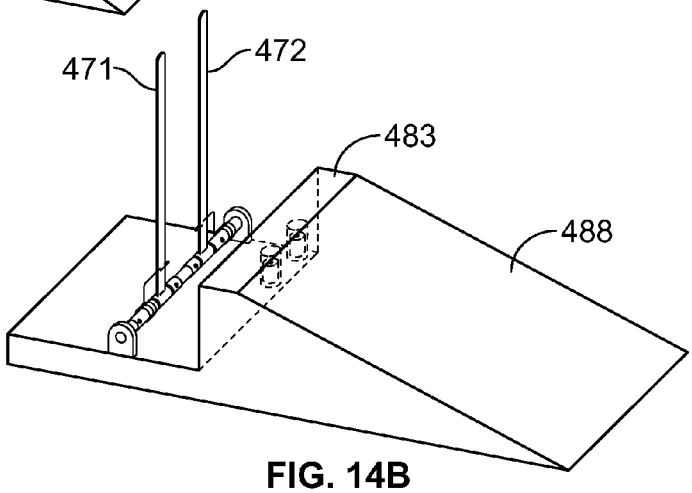
FIG. 14B is a perspective view of a mechanical catch with a pair of beam sensors mounted in the wedge.
Figure 14C:
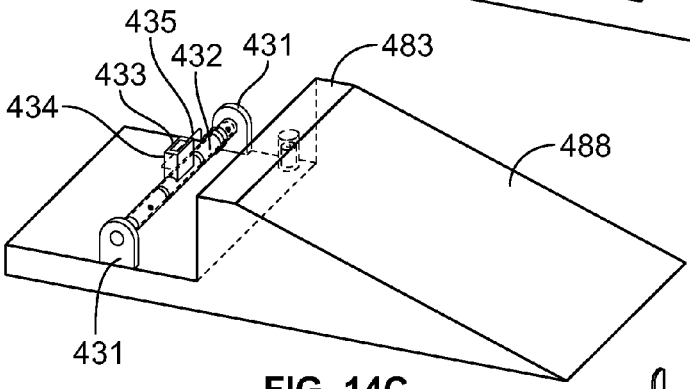
FIG. 14C is a perspective view of a socketed stick sensor.
Figure 14D:
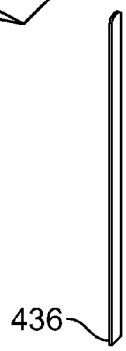
FIG. 14D shows a plain socket stick sensor.
Figure 14E:
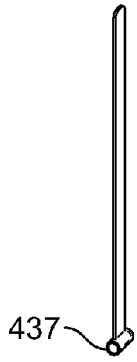
FIG. 14E shows a sleeve socket stick sensor.
Figure 14F:
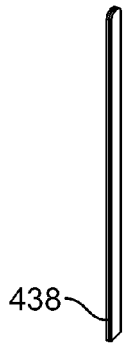
FIG. 14F shows a laminate double width socket stick sensor.
Figure 15A:
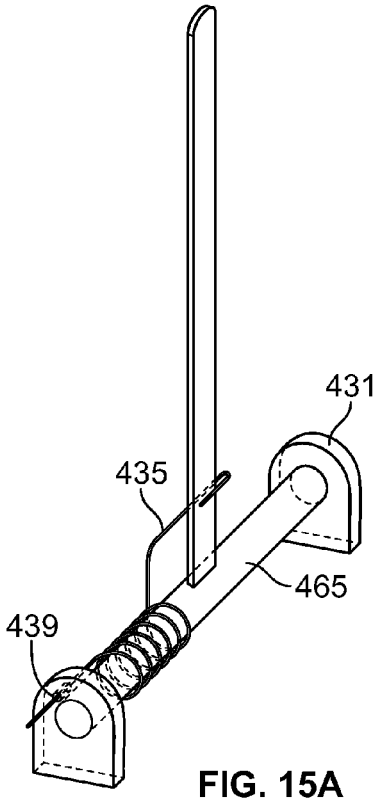
FIG. 15A is a perspective view of a mechanical restoring mechanism having a single stick sensor.
Figure 15B:
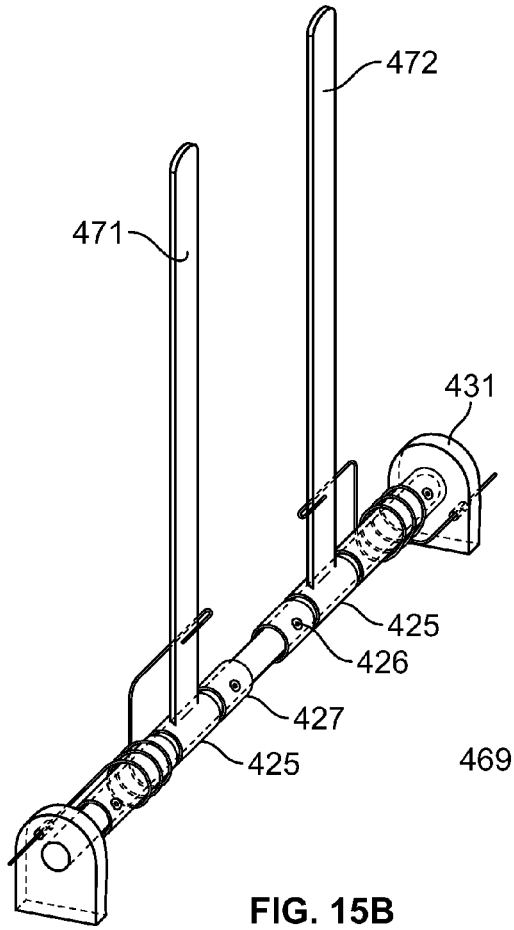
FIG. 15B is a perspective view of a mechanical restoring mechanism having a pair of sticks sensors.
Figure 15C:
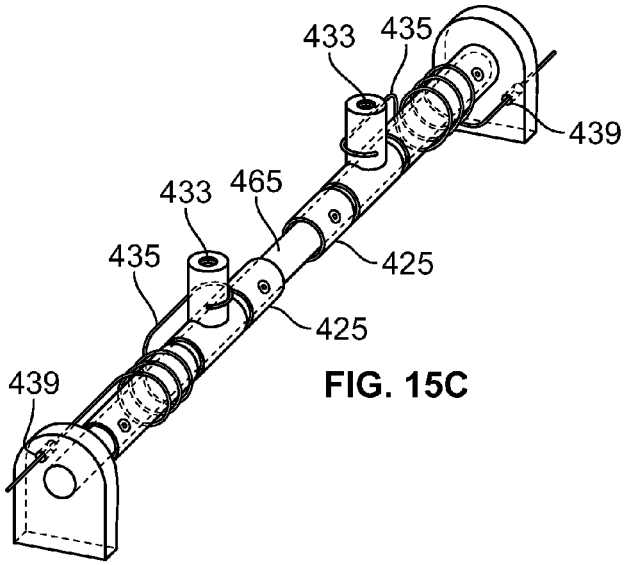
FIG. 15C is a perspective view of a mechanical restoring mechanism having a pair of internally threaded sockets.
Figure 15D:
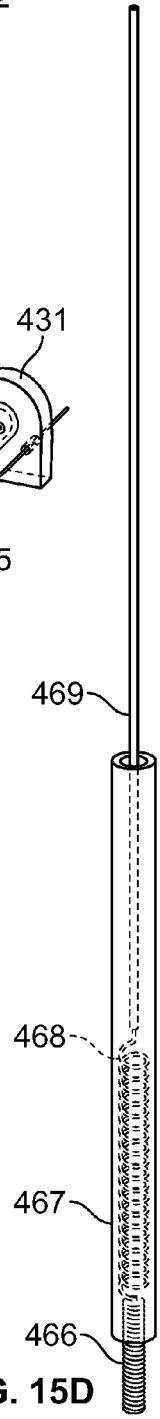
FIG. 15D shows an externally threaded stick sensor that goes into the internally threaded socket.
Figure 15E:
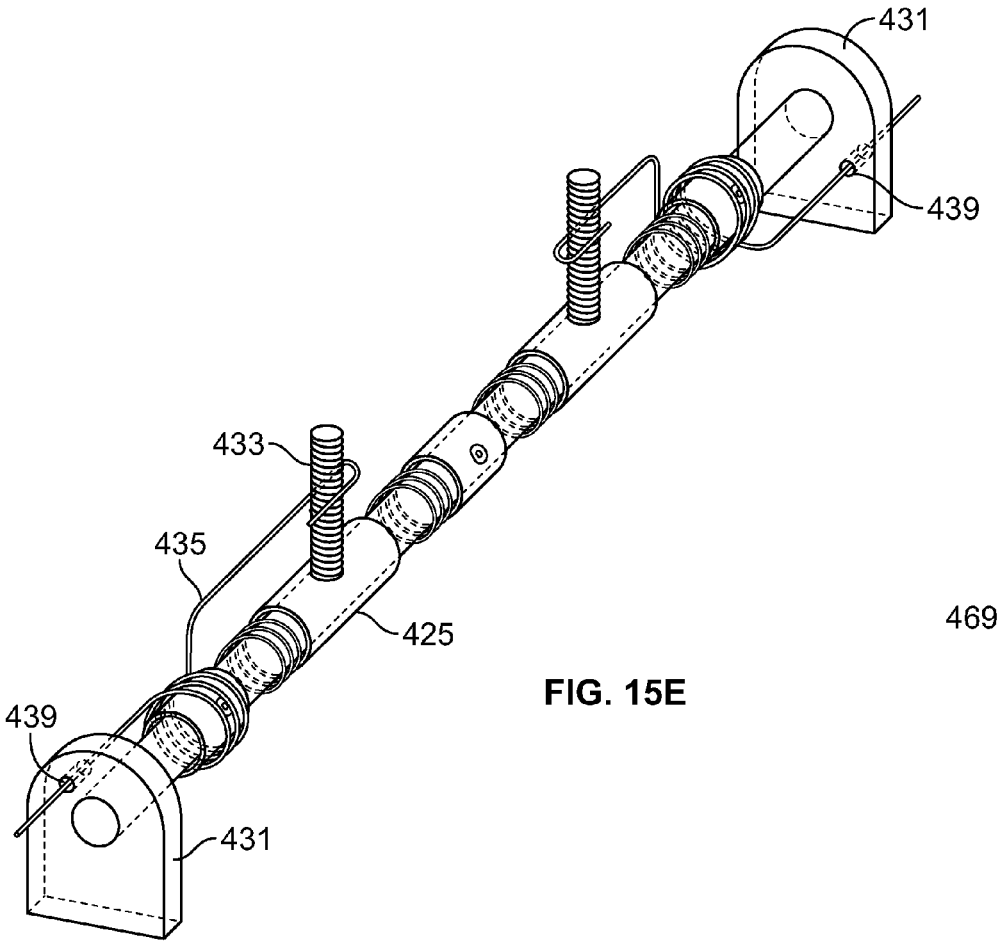
FIG. 15E is a perspective view of a mechanical restoring mechanism having a pair of externally threaded sockets.
Figure 15F:
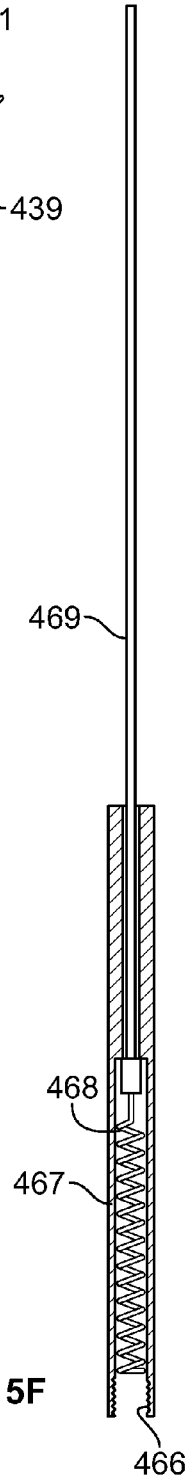
FIG. 15F shows an internally threaded stick sensor that goes onto the externally threaded socket.
Figure 16:
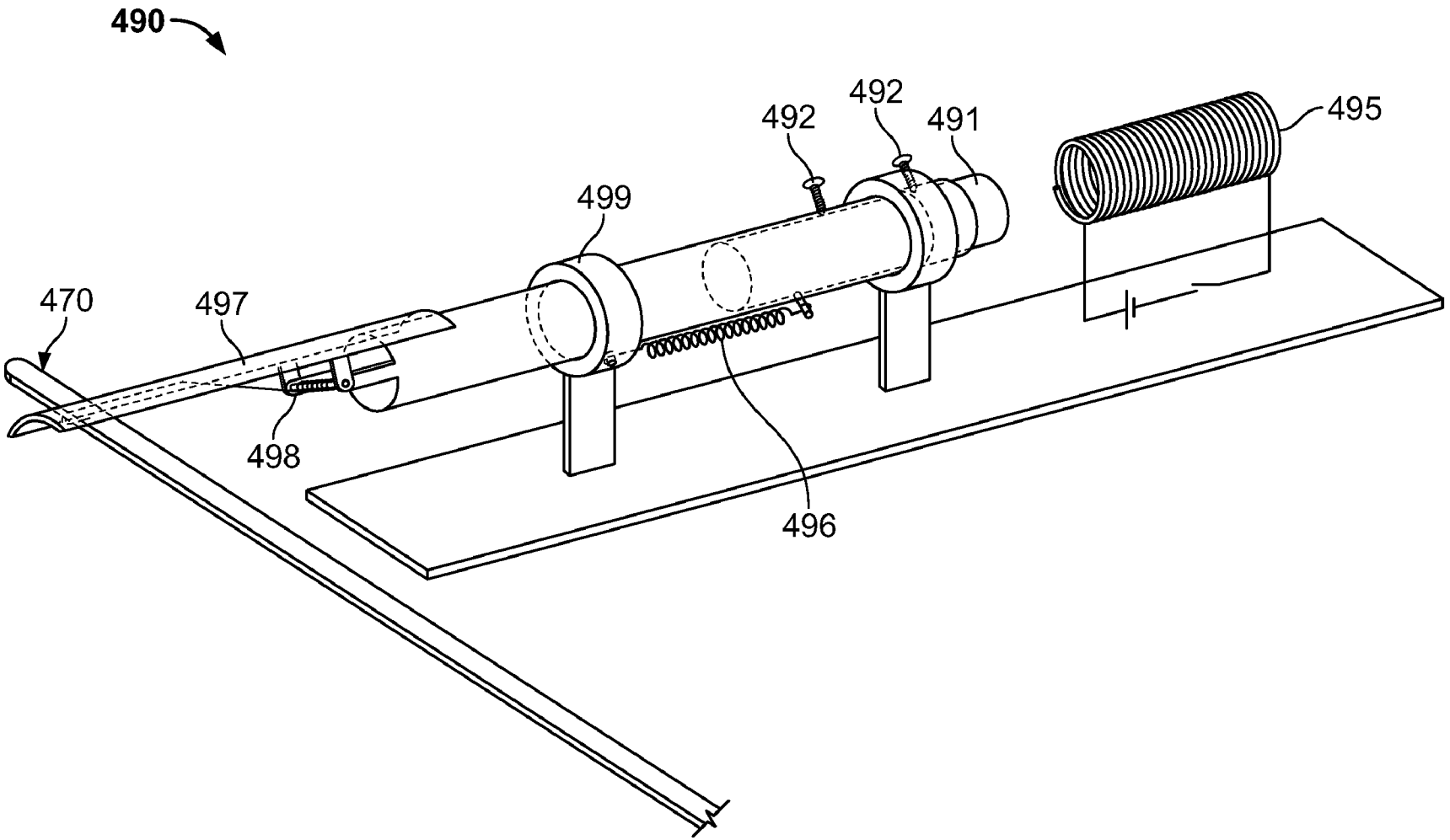
FIG. 16 is an exploded diagram of a mechanical catch mechanism, not drawn to scale.
Figures 17A, 17B:
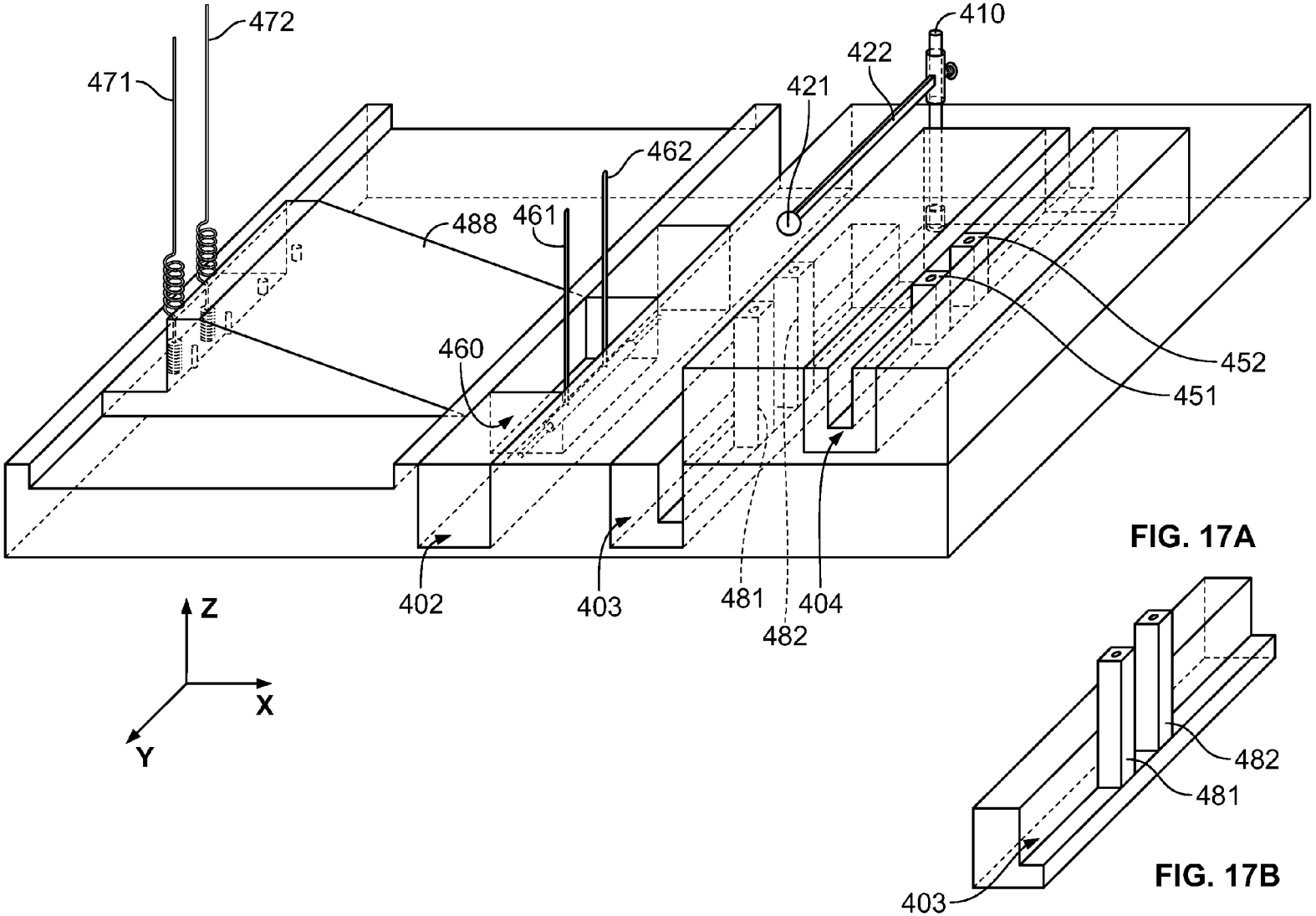
FIG. 17B is a perspective view diagram of a carriage showing the second row beam sensors mounted on the second row carriage.

FIG. 11 is a diagram of the third embodiment of the present invention. FIG. 12 shows a variety of components. FIG. 12A is a diagram of a carriage showing that three different heights of beam sensors can be mounted within the carriage. FIG. 12B is a diagram of a carriage showing stick sensors mounted within. FIG. 12C is a perspective view of the portable configuration of the third embodiment of the present invention. FIG. 12D is a perspective view of the present invention showing threaded sockets for thread stick sensor mounting, and unthreaded sockets for stick sensor placement.

The third embodiment of the present invention provides a portable golf swing trainer 400 that has a first configuration that is not portable, and a second configuration that is portable. The first mode includes a first slot 404, a second slot 403, a third slot 402 and a fourth slot 401. As in the first embodiment, a ball target 421 is disposed on a ball arm 422 and the ball target 421 rotates about a ball pivoting post 410. As before, the ball arm set screw 493 can be used for adjusting the position of the ball arm and ball target. Other miscellaneous mechanisms are incorporated herein by reference from the previous disclosure. The first row of sensors 450 has a first row first sensor 451 and a first row second sensor 452 mounted on a base 440.

Additionally, ramp mounted position sensors 411 can be mounted before the fourth row sensors 470 formed as sticks, and shown as a fourth row first stick sensor 471 and a fourth row second stick sensor 472. The third row of sensors 460 may be made as sticks, namely a third row first stick sensor 461 and a third row second stick sensor. Similarly, the second row sensors 480 can be made as sticks or beam sensors such as a second row first sensor 481 and a second row second sensor 482.

In the portable mode of the third embodiment, a sensor carriage 486 holds a plurality of position sensors 487. The sensor carriage 486 can be mounted in the first slot 404 in sliding configuration. The sensor carriage 486 can be secured inside the first slot after adjustment. A user takes practice swings to determine a path, or a golf pro trainer adjusts the sensors so that the sensors define a path of desired swing. The desired path may activate an audio feedback such as a tone such as a chime, or a chord that is comprised of individual sensors activating different musical notes of a chord. In the best mode of the third embodiment, there are a total of eight sensors in use typically, with the ramp mounted position sensors preferably activated only in the portable configuration. A mesa 483 is provided at the top of the ramp.

Each of the stick sensors and other sensors are preferably mounted within the carriage to provide left to right adjustment. In FIG. 12*b*, the carriage shown is for a pair of stick sensors mounted on a pair of stick sensor pivoting hinges 431. One or more stick sensor pivot springs 435 may restore the stick sensors to vertical position after a swing has hit the stick sensors to a prone position. The stick sensor carriage 485 provides a module that is modularly interchangeable for another type of sensor. The carriage also allows left to right adjustment.

A restoring mechanism 430 is preferably mounted behind the ramp, or on a carriage. Upon the carriage, the stick sensors can be moved closer to each other or a way from each other by means of set screws located on stick sensor pivoting sleeves 425. Stick sensor pivoting sleeve set screws 426 can secure the stick sensor pivoting sleeves 425 to the horizontal pivot member 465 at stick sensor pivoting sleeve ends 427. Preferably, there are a pair of stick sensors on a carriage and a pair of stick sensor pivoting sleeve ends for each stick sensor for a total of four stick sensor pivoting sleeve ends. Similarly, for each pair of stick sensor on a carriage there would be a pair of stick sensor pivoting sleeve set screws for a total of four stick sensor pivoting sleeve set screws. The restoring mechanism is preferably powered by helical springs that connect at one end to the stick sensor pivoting sleeves 425, and at another end to the base or stick sensor pivoting hinges 431.

The restoring mechanism 430 preferably generally includes a pivoting connector 432 that connects the stick sensor, which is typically vertical before being struck, to a horizontal pivot member 465. The pivoting connector 432 may have a variety of features such as a stick sensor socket aperture 433 on a socket. The socket aperture may have a threaded connection to a threaded portion of the stick sensor. The socket also would include a stick sensor socket body 434 which could have an externally threaded periphery connecting to an internally threaded stick sensor bottom portion. A variety of stick sensors may have different connection configurations, such as a stick sensor plain bottom 436, a stick sensor tubular bottom 437, or a stick sensor laminated bottom 438. The stick sensor plain bottom is smooth, the stick sensor tubular bottom is threaded, and the stick sensor laminated bottom is formed by a pair of stick sensors laminated together.

The restoring mechanism 430 preferably also includes a stick sensor pivot spring 435 that pivots the stick sensor relative to the base. The stick sensor pivot spring connects at a stick sensor spring connection 439 to the stick sensor pivot hinge 431 for the purpose of maintaining the stick sensor in vertical position. The stick sensors may have a stick sensor threaded connection 466, may have a stick sensor tubular sheath 467, a stick sensor threaded connection 466 or a stick sensor helical section 468. The stick sensor sensing portion 469 can be a brush, a single stick, or multiple sticks.

The position sensor carriage has a slot which is a position sensor slot 489 that receives one or a number of position sensors mounted within the slot. The preferred usage of the sensor slot is to first position the position sensors within the slot, so that the relative position of the position sensors are fixed, then second to position the carriage within the carriage slot. The sensor carriages can be adjusted horizontally left and right and also vertically so as to create a swing path profile for a user by having all of the tips of the stick sensors in the swing path so that a user may repeatedly practice the same swing path.

The stick sensors can be automatically restored by the restoring mechanism 430 and pivoting back to vertical position immediately after a swing has hit the stick sensors to a prone position, or the stick sensors can be retained in a prone position for swing analysis purposes. The catch mechanism 490 for catching the stick sensors into a prone position may comprise a mechanical catch, or a magnetic catch. A mechanical catch mounted on a catch mount 499 includes a catch slider 491 that is pulled toward a catch solenoid 495 when the solenoid is in energized state in the releasing position. The solenoid is more powerful than a catch slider spring 496 which slides the catch slider 491 back to catching position from the releasing position. The releasing position slides the catch retainer 497 away from the stick sensor so that the stick sensor can be restored by the restoring mechanism to the vertical position. The catch retainer 497 waits in catching position in the upward position and is biased downward when the stick sensor pivots downward. The stick sensor pushes past the catch retainer and the catch pivot spring 498 restores the catch retainer back to the upward position such that the stick sensor is retained underneath the catch retainer until the solenoid is engaged for release. The amount of sliding travel can be adjusted by catch set screws 492. Instead of using electricity, a user could always pull or push the catch slider 491 manually.

Alternatively, the catch mechanism 490 can be magnetic such as an electromagnetic coil so as to magnetically retain a stick sensor 470 that has sufficient magnetic material within it to engage with the catch mechanism 490 that is magnetic. When the stick sensor is hit, the electromagnetic coil is in active state and will retain the stick sensor against it when the stick sensor strikes the magnetic coil. The magnetic coil can be cushioned with a spring so as to provide more contact time to make an engagement with the similarly magnetized stick sensor 470. In this case, the catch retainer 497 can be mechanical or an electromagnetic coil. The catch mechanism is activated in both situations by an electrical switch shown in the drawings. The electrical actuator can be a push button or toggle switch.

The ramp 488 in the preferred embodiment can be removed from the fourth slot 401 so that the ramp 488 and the restoring mechanism 430 and the catch mechanism 490 become a portable unit that a user can carry around for practice on a field such as a practice field. The portable ramp retains the same restoring mechanism and catch mechanism. The portable practice ramp is wedged shaped having a wedge body and optionally includes ramp mounted position sensors 411 which can be used with or without the stick sensors behind the ramp. The ramp mounted position sensors FIG. 12D are preferably mounted within a pair of depressions on the face of the ramp.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims.

The invention claimed is:

1. A portable swing trainer comprising:

a. a base;

b. two rows of sensors disposed on the base;

c. a first pair of sensors disposed within the first row, wherein the first pair of sensors are formed as a first pair of stick sensors which have a vertical adjustment and a horizontal adjustment;

d. a second pair of sensors disposed within the second row.

2. The portable swing trainer of claim 1, further comprising:

a. a wedge body;

b. a wedge stick sensor having a vertical adjustment and a horizontal adjustment, wherein the wedge stick sensor has a deployed position and a collapsed position, wherein the wedge stick sensor is mounted behind the wedge body; and c. a restoring mechanism for restoring the wedge stick sensor from the collapsed position to the deployed position, wherein the restoring mechanism is mounted behind the wedge body, wherein the wedge stick sensor is pivotally mounted to the restoring mechanism.

3. The portable swing trainer of claim 1, further comprising:

a. a base;

b. a first pair of sensors disposed on the base;

c. a second pair of sensors disposed on the base, wherein the second pair of sensors is behind the first pair of sensors;

d. a third pair of sensors disposed on the base, wherein the third pair of sensors is behind the second pair of sensors;

e. a fourth pair of sensors disposed on the on the base, wherein the second pair of sensors comprises a pair of second stick sensors, wherein the pair of second stick sensors has a vertical adjustment and a horizontal adjustment.

4. The portable swing trainer of claim 1, further comprising:

a. a base;

b. a first pair of sensors disposed on the base, wherein the first pair of sensors is mounted on a first sensor carriage, wherein the first sensor is slidably mounted in a first sensor carriage slot;

c. a second pair of sensors disposed on the base, wherein the second pair of sensors is behind the first pair of sensors, wherein the second pair of sensors is mounted on a second sensor carriage, wherein the second sensor is slidably mounted in a second sensor carriage slot;

d. a third pair of sensors disposed on the base, wherein the third pair of sensors is behind the second pair of sensors;

e. a fourth pair of sensors disposed on the on the base, wherein the second pair of sensors comprises a pair of second stick sensors, wherein the pair of second stick sensors has a vertical adjustment and a horizontal adjustment.

5. The portable swing trainer of claim 1, further comprising a catch mechanism that is a mechanical catch and further comprises:

a. a catch mount having a catch slider;

b. a catch solenoid that when in an energized state moves the catch slider to a releasing position, wherein the solenoid moves the catch slider against a catch slider spring, wherein the catch slider spring slides the mechanical catch back to catching position from the releasing position.

6. A portable swing trainer comprising:

a. a wedge body;

b. a stick sensor having a vertical adjustment and a horizontal adjustment, wherein the stick sensor has a deployed position and a collapsed position, wherein the stick sensor is mounted behind the wedge body; and c. a restoring mechanism for restoring the stick sensor from the collapsed position to the deployed position, wherein the restoring mechanism is mounted behind the wedge body, wherein the stick sensor is pivotally mounted to the restoring mechanism.

7. The portable swing trainer of claim 6, further comprising:

a. a base;

b. four slots disposed on the base, wherein the slots comprise: a first slot, a second slot, a third slot and a fourth slot;

c. a first pair of sensors disposed within the first slot;

d. a second pair of sensors disposed within the second slot;

e. a third pair of sensors disposed within the third slot;

f. a fourth pair of sensors disposed on the wedge body, wherein the wedge body fits within the fourth slot, wherein the second pair of sensors comprises a pair of second stick sensors, wherein the pair of second stick sensors has a vertical adjustment and a horizontal adjustment; and g. a catch mechanism for catching the stick sensor in collapsed position, wherein the catch mechanism is mounted behind the wedge body.

8. The portable swing trainer of claim 6, further comprising:

a. a base;

b. a first pair of sensors disposed on the base;

c. a second pair of sensors disposed on the base, wherein the second pair of sensors is behind the first pair of sensors;

d. a third pair of sensors disposed on the base, wherein the third pair of sensors is behind the second pair of sensors;

e. a fourth pair of sensors disposed on the on the base, wherein the wedge body is behind the third pair of sensors.

9. The portable swing trainer of claim 6, further comprising:

a. a base;

b. a first pair of sensors disposed on the base, wherein the first pair of sensors is mounted on a first sensor carriage, wherein the first sensor is slidably mounted in a first sensor carriage slot;

c. a second pair of sensors disposed on the base, wherein the second pair of sensors is behind the first pair of sensors, wherein the second pair of sensors is mounted on a second sensor carriage, wherein the second sensor is slidably mounted in a second sensor carriage slot;

d. a third pair of sensors disposed on the base, wherein the third pair of sensors is behind the second pair of sensors;

e. a fourth pair of sensors disposed on the on the base, wherein the wedge body is behind the third pair of sensors; a catch mechanism for catching the stick sensor in collapsed position, wherein the catch mechanism is mounted behind the wedge body.

10. The portable swing trainer of claim 6, further comprising a catch mechanism that is a mechanical catch and further comprises:

a. a catch mount having a catch slider;

b. a catch solenoid that when in an energized state moves the catch slider to a releasing position, wherein the solenoid moves the catch slider against a catch slider spring, wherein the catch slider spring slides the mechanical catch back to catching position from the releasing position.

11. The portable swing trainer of claim 6, further comprising a catch mechanism that is an electromagnetic catch.

12. A portable swing trainer comprising:

a wedge body; and a pair of sensors mounted in a pair of depressions formed on a face of the wedge body; and further comprising a. a base;

b. four slots disposed on the base, wherein the slots comprise: a first slot, a second slot, a third slot and a fourth slot;

c. a first pair of sensors disposed within the first slot;

d. a second pair of sensors disposed within the second slot;

e. a third pair of sensors disposed within the third slot;

f. a fourth pair of sensors disposed on the wedge body, wherein the wedge body fits within the fourth slot.

* * * * *